United States Patent [19]

Morganroth

[11] 4,211,247

[45] Jul. 8, 1980

[54] DEVICES FOR USE IN SELECTIVELY ALTERING HAIR COLOR

[76] Inventor: Shila Morganroth, 1225 Waterbury Rd., Highland, Mich. 48031

[21] Appl. No.: 592,764

[22] Filed: Jul. 2, 1975

Related U.S. Application Data

[63] Continuation-in-part of Ser. No. 481,695, Jun. 25, 1974.

[51] Int. Cl.[2] ..... A45D 40/26

[52] U.S. Cl. ..... 132/88.7

[58] Field of Search ..... 132/88.7, 885, 79, 110, 132/116, 46 R, 48 R; 15/140.3, 105; 401/208, 218, 13, 220, 219, 28

[56] References Cited

U.S. PATENT DOCUMENTS

| | | | |
|---|---|---|---|
| D. 113,690 | 3/1939 | Tresenberg | 132/88.7 |
| 1,516,661 | 11/1924 | Bechtold | 132/48 R |
| 1,531,245 | 3/1925 | Ozanne | 75/140.3 |
| 1,565,979 | 12/1925 | Bachrach | 401/219 |
| 2,437,298 | 3/1948 | Heyman | 132/110 |
| 2,819,723 | 1/1958 | Meyer | 132/116 |
| 2,932,045 | 4/1960 | Rabelow | 401/218 |
| 2,944,273 | 7/1960 | Harris | 15/105 |
| 3,027,591 | 4/1962 | Petersen | 401/208 |
| 3,088,470 | 5/1963 | Hall | 132/79 |
| 3,104,413 | 9/1963 | Nelson | 401/208 |
| 3,204,644 | 9/1965 | McDougall-Kaley | 132/9 |
| 3,304,945 | 2/1967 | Anderson | 132/9 |
| 3,417,761 | 12/1968 | Kulnis et al. | 132/46 R |
| 3,570,499 | 3/1971 | Ruta | 132/9 |
| 3,702,739 | 11/1972 | Rentfrow | 401/220 X |
| 3,721,502 | 3/1973 | Ognibene | 401/13 |

FOREIGN PATENT DOCUMENTS

| | | | |
|---|---|---|---|
| 1262141 | 2/1972 | United Kingdom | 132/80 |

*Primary Examiner*—G. E. McNeill

*Attorney, Agent, or Firm*—George H. Mortimer

[57] ABSTRACT

The invention relates to a number of different devices that are useful in selectively altering hair color by the application of hair color altering liquids to selected portions of the hair of men and women. These include applicators that are adapted for use with, or are actually used with, squeeze bottles to hold the hair color altering liquids such as bleaches, tints, toners and the like, combs with absorbent jackets to hold such liquids by absorption and to yield them up to the hair as the comb is passed through it, and clamps to control the length of the hair to which liquids are applied by these or other methods of application. The applicators comprise an elongated, slender, preferably frusto-conical parting tools molded integrally to a closure cap that may be screwed or otherwise removably secured to the bottle and spreading means such as rollers, spatulas, brushes, sponges, fibers such as cotton batting, balls, transversely broadened smooth integrally molded spreaders intermediate in height between the cap and the free end of the parting means and spaced therefrom so as not to interfere with its use as a parting tool. The clamps comprise a pair of bars recessed on the facing surfaces with recesses for tresses, hinged at one end and removably locked together at the other and with a sheet of rubber or plastic secured to one of the bars to protect underlying hair and scalp from contact with the liquid that is spread into the hair below the clamp. A second clamp may be used at the outer end of new growth, if desired.

29 Claims, 60 Drawing Figures

FIG. 41
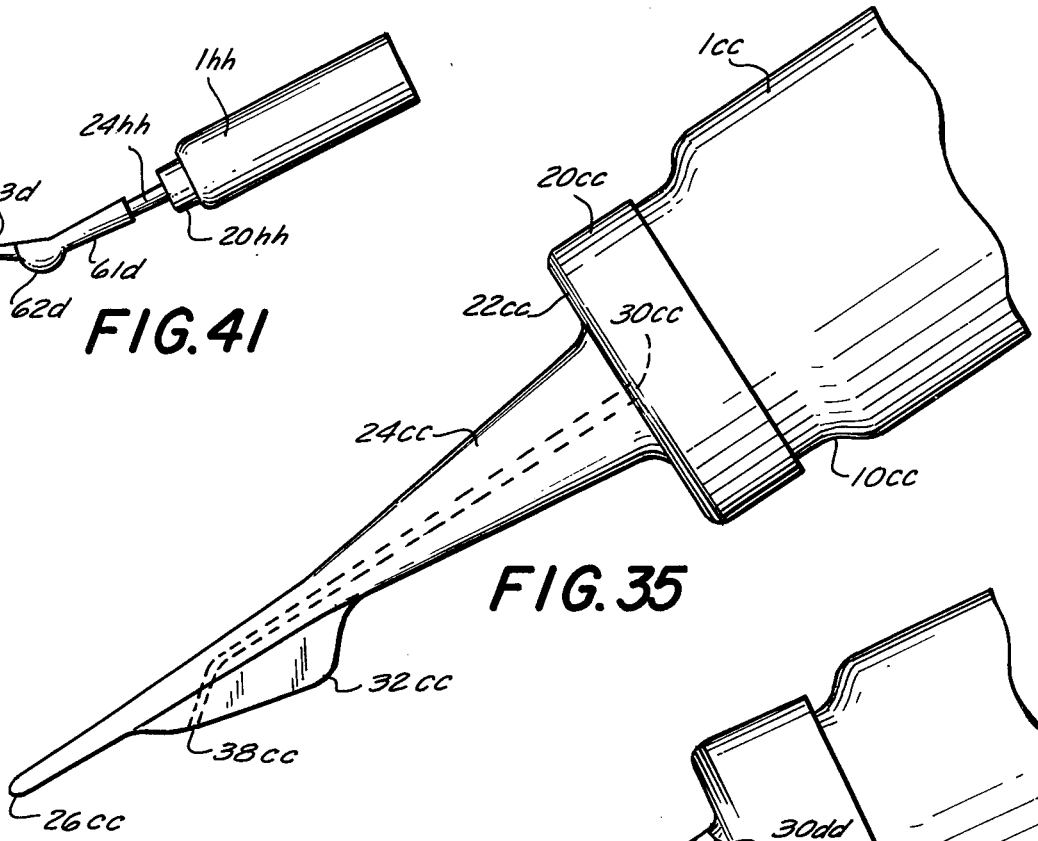
FIG. 35
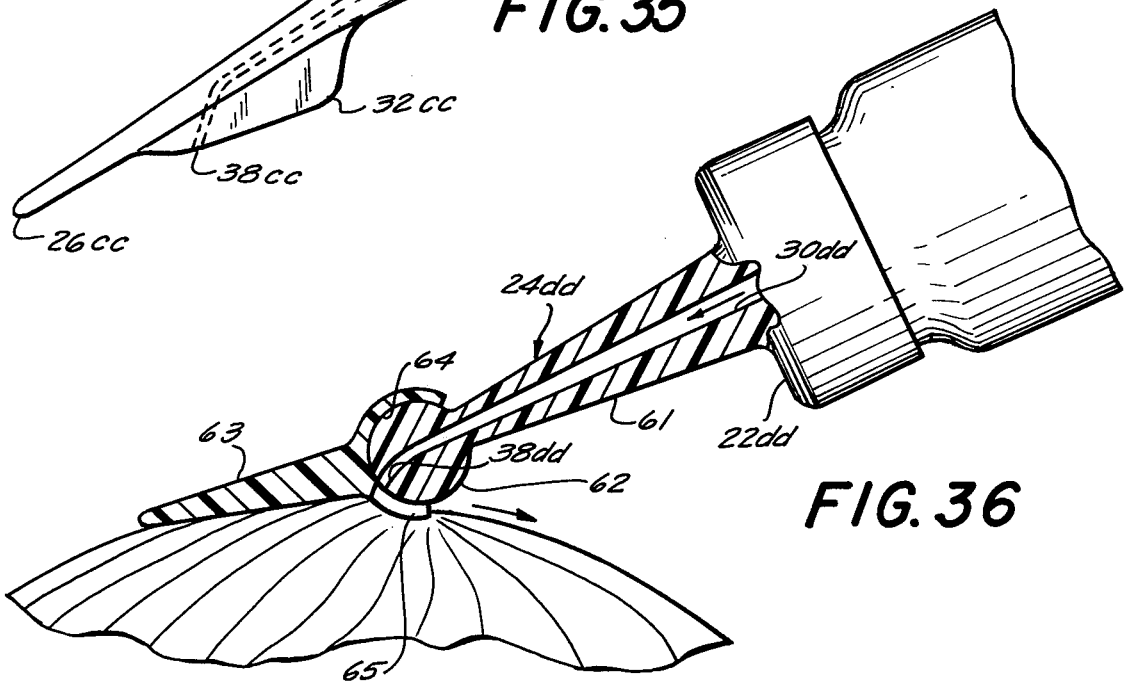
FIG. 36
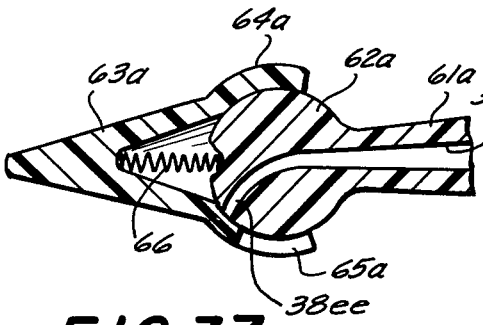
FIG. 37
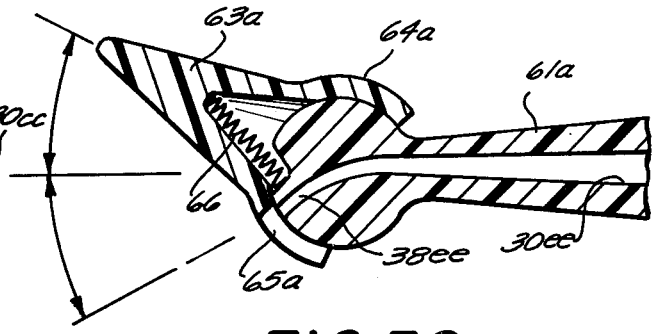
FIG. 38

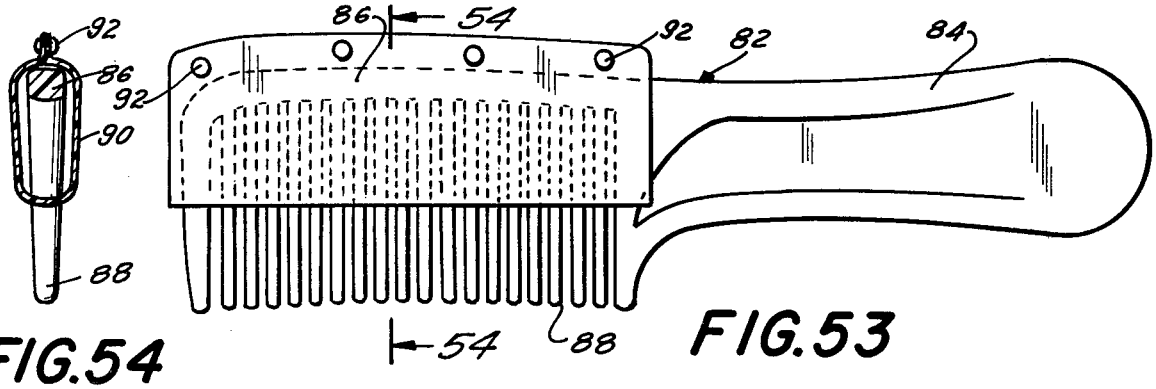
FIG.54
FIG.53
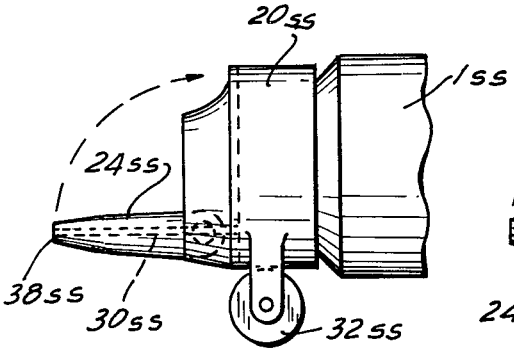
FIG.51
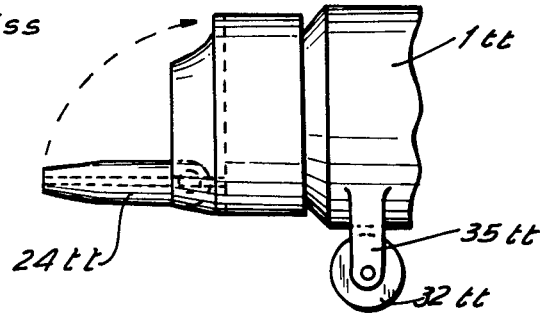
FIG.52
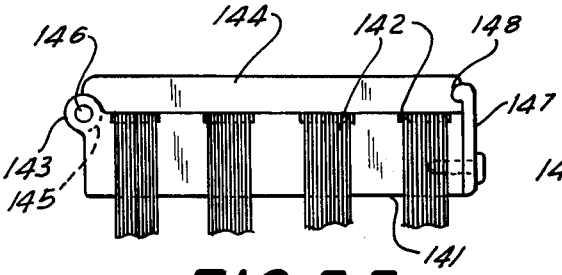
FIG.55
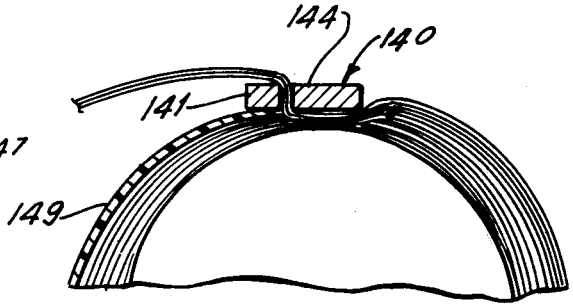
FIG.56
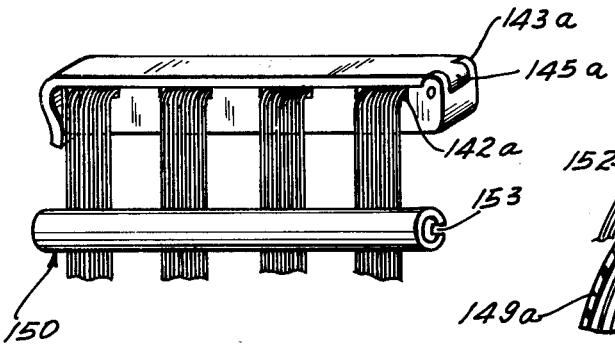
FIG. 57
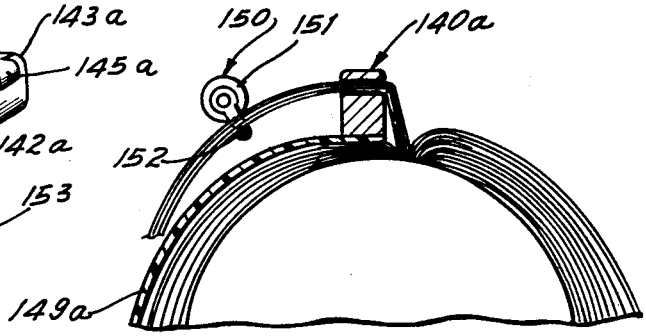
FIG.58

DEVICES FOR USE IN SELECTIVELY ALTERING HAIR COLOR

This application is a continuation-in-part of my prior application Ser. No. 481,695, filed June 25, 1974.

INTRODUCTION

The present invention relates to devices for use in altering hair color selectively. Methods having the purpose of producing hair of variegated colors, preferably in the same color family, by spreading a hair treating liquid onto, and in some cases into, strands or tresses or cubes of hair to produce the different colors or hues and packages for use in such methods form the subject matter of copending application Ser. No. 579,012, filed May 19, 1975, entitled "Methods of Selectively Altering Hair Color And Packages For Use Therewith." The devices of the present invention may be used in carrying out these and other methods which require spreading means for such hair treating liquids, and/or means to control the area of the hair to receive the liquid, and/or supplying the liquid to the spreading means, and/or parting tools to form strands or tresses or cubes for receiving liquid. The devices may be used for applying hair treating liquids to obtain many different variegated effects, including hair bleaching with milder readily flowable bleach materials that may safely be used against the scalp; hair coloring such as hair tinting and hair toning; hair shading; hair frosting; hair tipping and the like. The word "liquid" as used herein is intended to be broad enough to include any spreadable material even if it will not flow readily because of high viscosity. The devices are adapted for use by nonprofessionals as well as professionals in any and all of these operations and can be used with equal ease in hair treating operations by right-handed and left-handed operators.

BACKGROUND OF THE INVENTION

Hair treatment, including hair coloring, is an ancient art. The oldest available records show that women then, as now, were not satisfied with their natural hair coloring and used available materials in an attempt to obtain a hair color which they considered more desirable than nature had provided. Among other coloring materials that were used anciently are henna, a red vegetable dye; indigo; sage; and camomile. Dark haired women in the time of Rome's zenith, who admired the blood hair of female slaves brought from northern Europe, used saffron, red arsenic, nut shells and plant ash to bleach their hair. Later it was found that if the hair was wet with soap and exposed to the sun it would lighten. Mixtures of alum, black sulfur and honey have also been used as lightening agents. In the latter part of the 19th century synthetic dyes, particularly paraphenylenediamine, were developed and offered for hair coloring, either alone or in admixture with metallic salts. Oxidizing agents, particularly hydrogen peroxide, came into rather widespread use as the bleaching agent to lighten hair.

Until relatively recent times little was known and understood about the structure of hair and the mechanics of hair coloring. Through microscopic study of the hair it has been determined that a typical hair shaft, the part of the hair outside the hair follicle where the hair is formed, comprises an outer sheath of scales called the cuticle, the main body of the hair called the cortex and a slender central filament called the medulla.

The scales of the cuticle are plate-like in shape and cover the cortex somewhat in the same general manner that shingles cover the roof where the root of the hair corresponds to the ridge and the end of the hair corresponds to the eaves. This arrangement of the scales permits the hair to be combed from the scalp outward without damage to the cuticle, just as water can flow down a roof that is well shingled without causing leakage, whereas brushing or combing the hair toward the scale tends to damage the cuticle just as a stream of water directed upwardly on a roof could easily cause leakage by penetration between the shingles and, if the force of the upwardly directed stream is strong enough, the shingles could be lifted and even torn from the roof. Being transparent, and colorless, the scale cells of the cuticle are not altered in color by bleaching agents but they must be altered structurally so as to permit the coloring solutions to pass through the cuticle and penetrate the cortex and the cuticle may be subjected to damage if the treating liquids are improperly used.

The cortex is composed of elongated cells, rather typical of fibers, comprised of complex proteins among which all the pigments that give the hair its color are found. Pigments are of different colors, such as yellow, red, brown, black, etc., and in general a hair shaft will contain pigment cells of several different colors. Pigments of different colors are affected differently by bleach and lightening solutions. In general such solutions attack the darker colors first and it has been found useful to divide the bleaching or lightening process from black to very light hair in stages which are referred to as follows:

Stage 1—black
Stage 2—brown
Stage 3—red
Stage 4—red-gold
Stage 5—gold
Stage 6—yellow
Stage 7—pale yellow
Stage 8—white Bleaching and lightening liquids, however, affect not only the pigment cells but also other cells of the hair and some chemical bleachants under some conditions may have a variety of adverse effects on the structural part of the hair, e.g., seriously weaken or embrittle the hair so that it will break off in wet or dry condition; cause hair to lose its normal springiness or resilience when highly bleached (to Stage 7 or 8) so that in wet condition it feels like sponge or rubber, will stretch like a thin rubber filament if pulled, will break if stretched beyond the elastic limit, and in dry condition it is brittle and snaps off if bent; and reduce the ability of the hair to take up color in the normal manner. In many cases the scalp may also be deleteriously affected by contact for too long a period of time with the bleachants used on the hair.

The medulla is not always present and is of little importance in coloring and otherwise treating the hair.

Hair coloring of the permanent type as practiced today may be carried out (a) in two operations which are frequently referred to as (1) bleaching or prelightening and (2) tinting, toning, or coloring, or (b) in some cases, in a single operation which comprises bleaching or ightening the natural pigments and simultaneously depositing other pigments in the cortex of the hair.

The one step process was not introduced in the market place until about 1950 after which it became very popular but it has not completely displaced the two step process which is still necessary if a person desires to change the color of the hair through several stages of lightening.

Permanent hair coloring is somewhat of a misnomer because no known process of hair coloring is able to affect the natural color of new hair that grows out after a so-called permanent color is applied. The word "permanent" as used i this art means only that the color which is applied to the then existing shaft of the hair is not washed out with shampoo and water. The most popular way of obtaining permanent hair coloring is by the use of penetrating tints or dyes which deposit pigment in the cortex of the hair shaft. It is possible, however, to apply a coating tint on the cuticle layer but this produces an unnatural look that most persons consider far less satisfactory than the appearance obtained by the use of a penetrating tint.

Semipermanent hair coloring differs from the permanent type in that it will wash out but requires several shampooings before all the color is removed. It is used primarily either to color gray hair without changing the color of the remaining pigmented hair or to make gray hair a color that the person prefers to the natural gray. In general the coloring materials used to obtain semipermanent hair coloring are the penetrating type but they are gentler on the tissues and require no peroxide developer.

Temporary hair colorings differ from the permanent and semipermanent colorings in that they deposit color on the cuticle of the hair shaft, have no lasting effect on the hair color and are washed out by shampooing. In general temporary hair coloring materials are either rinses, highlighting shampoos or materials that can be applied to the hair in the form of powders, creams, or sprays.

Hair treating materials that are applied to the hair as a liquid may be any of these types:

(a) a single material which is normally liquid within the temperature range used for hair treating, (b) a solution of one or more materials in a liquid vehicle, including coloidal solutions, emulsions of one liquid in another, or (c) suspensions of a finely divided solid material in a carrier liquid. It is this type with which the present invention is more particularly concerned.

These materials have various viscosities and flow rates that may vary with temperature.

There are two general ways in which liquids are applied to the hair to be treated. One may be called an all-over application process of which coloring shampoos and rinses are typical examples. This method has been used satisfactorily for certain types of hair treating materials which are relatively nonirritating to the scalp, nondamaging to the hair and which do not have critical time periods that must be observed in order to get satisfactory results. Many hair treating materials do not satisfy these criteria and are therefore applied in the other method which may be called a step-wise or progressive method, i.e., the treating liquid is aplied successively or progressively to small sections of the hair until the entire operation of treating the entire head of hair therewith has been completed. Various methods are already known for effecting this progressive application of a hair treating liquid to the hair. Beginning some four decades ago color was first applied with a swab. This was followed by the bowl and brush method in which the liquid to be applied was prepared in an open bowl and applied by means of a brush that was dipped into the liquid in the bowl and then moved to the section of the hair that was ready to receive the liquid where it was applied by brush strokes primarly in the direction from the scalp toward the ends of the hair. A more rapid method of applying hair treating liquids to the hair came with the use of a squeeze bottle having an externally threaded cylindrical neck on which a sectioning and disensing attachment or applicator is screwed. This attachment comprises a body having an internally threaded cylinder or collar to be screwed on the neck of a squeeze bottle projecting outwardly in one direction and an elongated projection extending outwardly in the opposite direction, e.g., a frustum of a cone or the like, having a tapered passageway for liquid passing completely through it. The hollow projection is referred to inthe art variously, e.g., as a tip or knife. A bottle and attachment of this type is shown in Levie U.S. Pat. No 2,794,440 for hair waving solutions. An operator is able to form successive sections of a customer's hair with such a device by holding the squeeze bottle as a handle and using the tip in the same way that a rattail comb is used, although Levie shows the use of a rattail comb anyway. Such a section of the hair, which may be about ¼ inch up to 1 ½, or even 3 to 4 inches, wide and ordinarily not more than about ⅛ inch thick, is referred to variously in the art as a lock, strand or tress of hair. After the operator has formed such a strand of hair in this way, it is held taut by one hand while the other hand squeezes the bottle to force a thin stream of liquid through the tip, e.g., onto the scalp along the near part line of the strand at the area to be treated for touch-ups or along a strand or tress for an overall treatment. The liquid must next be spread evenly and uniformly on only the new growth in touch-ups or through each strand or tress for overall treatment. The smooth tip of the applicator is worthless as a spreading device, or as a device to pick up excess dripping material near the hairline, so most operators effect the spreading of the liquid through a tress by the thumb and fingers and through the root areas on touch-ups and pick-up of excess liquid by the thumb of the band that holds the strand of hair being treated.

These methods produced heads of hair of uniform color that at one time were very fashionable whereas today women desire a more natural appearing head of hair which is characterized by somewhat darker shades underneath near the nape of the neck, somewhat lighter shades near the face and highlights on the surface, particularly when the hair has been exposed to sunlight. In order to accomplish this result on heads of virgin hair which lack the highlights and on heads of tinted and toned hair, various ways of dimensional hair coloring, hair painting, streaking, frosting, tipping and the like have been proposed. In these process the use of cotton swabs and brushes have been suggested for transferring the thick, viscous bleach material, e.g., a mixture of about 2 parts Basic White with 1 part by volume of hydrogen peroxide solution of suitable strength, to the portions of the hair to be treated. In hair painting or streaking, for example, the process of the prior art comprises parting the hair, combining it down and then painting the viscous or pasty material in narrow spaced stripes on the surface of the hair from about one half inch away from the scalp down at least on that portion of the hair which is supported by the head, starting near the front adjacent to the face and proceeding toward the back of the head. Since the viscous bleach material is too thick to flow and only surface hairs have it applied to them, the streaks developed by this process are lost to view if the hair is parted in a location different from that where it was parted for the painting operation. Another suggested procedure was to part off strands about ½ by 1 1 to 2 inches, protect the hair behind each strand with heavy cream and/or cotton, placig a piece of foil under the strand and applying the viscous mixture to the strand starting about ½ inch away from the scalp and stopping short of the ends if they are damaged. After developing until the strands have reached golden blond stage, the viscous material is reapplied to the portion of the strand previously painted and to the ends until the hair is light enough when the action of the bleach is arrested. In hair frosting and tipping the prior art has taught parting off sections about an inch square, picking up tiny strands of about a dozen hairs each from a section with a fine rattail comb by a darning movement, laying them on a piece of foil placed over the remainder of the hair in the section, brushing the viscous bleach material on the tiny strands, folding the foil around these painted strands, and continue this procedure in checkerboard fashion until the desired area has been treated. After a period of time sufficient to develop the desired color in the painted strands the action is stopped by rinsing the strands individually in soapy water. Toner was applied if desired before shampooing to remove the material. For so-called blonde on blonde hair styling it was suggested to develop a desired blonde shade with toner on the whole head of hair, then section out spaced strands about ¾ inch square in checkerboard fashion to cover the entire head, each strand being wrapped in aluminum foil, whereupon the second toner was applied to all the hair not covered including the base of the wrapped strands, allowed to develop about half and hour, then carefully rinsed and shampooed before removing the foils.

The present invention provides devices for parting the hair to form tresses and for efficiently transferring to and spreading such hair treating materials on the hair so as to control the area on which the materials are spread which overcome the disadvantages of devices used heretofore.

DESCRIPTION OF SPECIFIC EMBODIMENTS OF THE INVENTION

Specific embodiments of the invention will now be described in conjunction with the drawings in which:

FIG. 35 is a fragmentary side view of a device embodying the invention utilizing a spatula-like spreading means;

FIGS. 36, 37, 38, 39, 40 and 41 are fragmentary side and sectional views, in whole or part, of hair treatment devices embodying modifications of spreading means including a ball-shaped enlargement at an intermediate position on the spreading means;

FIG. 51 is a fragmentary side view of a squeeze bottle having a cap removably secured thereto which has a foldable parting means pivoted thereto and a spreading means on the flange or collar;

FIG. 52 is a fragmentary side view of a device similar to FIG. 51 with the spreading means on the bottle near the shoulder;

FIG. 53 is an elevational view of a comb having a removable jacket secured thereto for holding spreadable liquids;

FIG. 54 is a sectional view of the device of FIG. 53 along the line 54—54;

FIGS. 55 and 56 are, respectively, a fragmentary top plan view and a sectional view of a clamp and scalp protector illustrating another embodiment of the invention for spreading hair color altering liquids with control of the area that liquids contact;

FIGS. 57 and 58 illustrate a further embodiment of clamp and scalp protecting device similar to that of FIGS. 55 and 56 with which a second clamp or the like may be used to control by physical means the entire area on which hair color altering liquids are spread on the hair;

Figure 1:
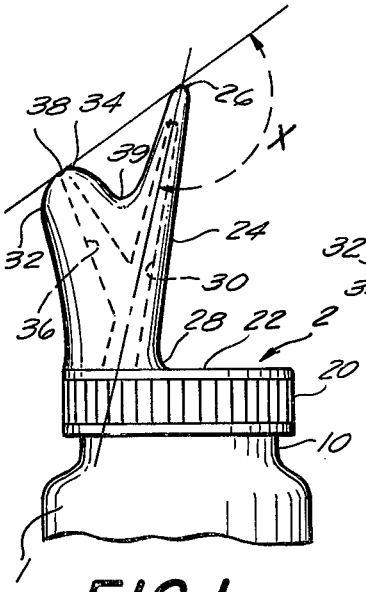
FIG. 1 is a side view of a device embodying the invention for parting hair and spreading liquid which comprises a squeeze bottle (shown fragmentarily) and a cap.
Figure 2:
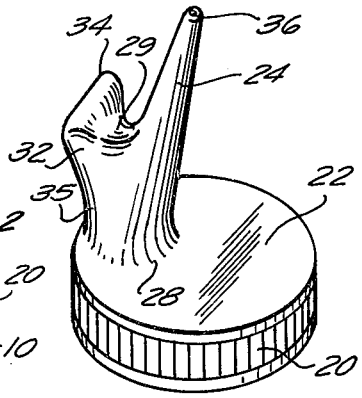
FIG. 2 is a perspective view of the cap of the device of FIG. 1.

Referring first to FIGS. 1 and 2, the device of the invention for use in altering hair color selectively comprises a squeeze bottle 1 adapted to hold a liquid capable of altering hair color and means 2 adapted to be secured to the squeeze bottle to close the end thereof and provide a hair parting means and a liquid spreading means. While any type of removable connection between the squeeze bottle 1 and the means 2 may be used, a preferred connection is made by a neck 10 of somewhat reduced diameter as compared with the diameter of the bottle 1 which is provided with external screw thread and a collar 20 having a closure member 22 secured to the upper edge thereof and which is imperforate except for a liquid discharge outlet referred to hereinafter. The collar 20 is internally threaded to cooperate with the external threads on the neck 10 to seat the closure member 22 tightly against the end of the neck when member 2 is screwed down tight so as to provide a liquid tight seal or closure for the squeeze bottle.

An elongated slender hair parting means 24 is secured at one end to the member 22 at any suitable location and rises from it with its axis at any suitable angle. The location of the connection of 24 to 22 may be either adjacent to the collar or centrally or anywhere between these two extremes. In the embodiment of the invention illustrated in FIGS. 1 and 2 the hair parting means 24 is somewhat frust-conical in shape, as may best be seen in the perspective view of FIG. 2. As seen from the side in FIG. 1, hair parting means 24 arises from a peripheral position adjacent to the collar 20 and at an acute angle with respect to the closure member 22. As seen from a position at right angles to that of FIG. 1, i.e., looking at it from the right side of FIG. 1, the frusto-conical tip has its axis perpendicular to closure member 22, as may be seen from the perspective view of FIG. 2. The parting means has a tip 26 at the upper end and a base 28 at the lower end which preferrably is molded integral with the collar 20 and closure member 22. The hair parting means is also preferrably provided with a liquid passageway 30 which may extend only part way through the entire length of the hair parting means or, if desired, may extend outwardly through the tip 26. In the embodiment of FIG. 1, the passageway 30 terminates short of the tip for a reason soon to be described.

A liquid spreading means 32 is secured to the device and in this embodiment of the invention is preferrably integrally molded with the entire means 2. It is, in effect, an integral transverse enlargement 32 on the hair parting means 24 terminating in an upper end 34 which is spaced laterally from the parting means 24 toward the outside and inwardly from the tip 26 thereof, as seen in FIGS. 1 and 2. In other words, the upper end 34 of the enlargement 32 is not located as far above the closure 22 as is the tip 26 of parting means 24. This locates the upper end 34 of spreading means 32 at an intermediate position between the base 28 and the tip 26 of the hair parting means 24. The lateral spacing of the upper end 34 from parting means 24 toward the outside places it in position to contact the scalp when the squeeze bottle 1 is held in the hand. The end 34 is broad in a direction perpendicular to a plane through the axis of parting means 24 and the midpoint of enlargement 32. In pracrice a breadth of about ½ to ¾ inch has been found satisfactory. It is rounded as viewed from the side, as seen in FIG. 1, and also at each side, as seen in FIG. 2. Between the base 28 at the member 22 and the end 34 the enlargement 32 has a narrowed portion 35. A liquid passageway 36 is provided in the enlargement 32 terminating at the outer end in a discharge orifice 38 at the surface of the spreading means 32 and communicating with the passageway 30 at the inner end so that liquid contained within the squeeze bottle can be forcibly flowed out of the squeeze bottle by passsageways 30 and 36 through discharge orifice 38 onto the hair whereupon the liquid may be spread as desired by the rounded end 34 of the liquid spreading means 32. Between the rounded end 34 and the parting means 24 is a sort of saddle shaped surface 39 neatly curved or rounded in both direction, i.e., parallel and at right angles to the aforesaid plane. All exposed surfaces of 24 and 32 are rounded and smooth to enable the device to move through the hair without catching.

Figure 3:
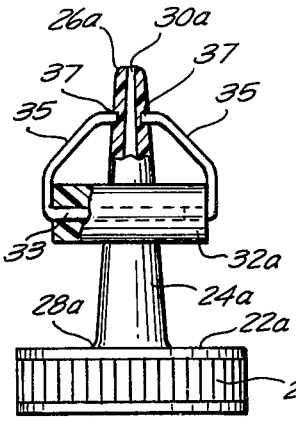
FIG. 3 is a front view of a different embodiment of the cap of the invention using a roller mounted on a two arm frame as the spreading means, with parts in section to show internal details.

Referring now to FIG. 3, the device comprises a collar **20*a*, closure 22*a* and a parting means 24*a* similar to the similarly numbered parts in FIG. 2 except that the parting means arises centrally from the closure 22*a* and has its axis perpendicular thereto in all directions and the liquid passage 30*a* goes entirely through the tip. The spreading means in this embodiment of the invention comprises a roller 32*a* rotatably mounted on an axle 33 passing through the roller and having arms 35 constituting a frame for holding the roller to the parting means 24*a* by means of a pivotal connection 37 at the end of each arm 35. In the position of the roller illustrated in FIG. 3, it occupies an intermediate position between the tip 26*a* and the base 28*a*. The pivotal connection at 37 permits the roller and its mounting frame to move through approximately 180° so that the roller occupies a position beyond the tip 26*a*. The reason for this arrangement is that when the roller occupies the position shown in FIG. 3 the parting means 24*a* can be used for making partings in the hair because the roller is out of the way of the tip end of the parting means. After the parting is made the roller and its frame can be swung through approximately 180° until the roller occupies a position beyond the tip where it can be used to spread liquid flowing out of the passageway 30*a* onto the hair as the device is moved in a direction along the axis of the parting means 24*a* and the tip 26*a* toward the base 28*a***.

Figure 4:
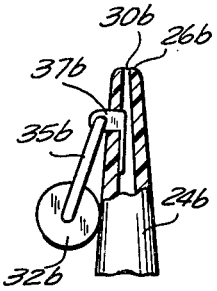
FIG. 4 is a fragmentary side view of an embodiment of the invention similar to FIG. 3 with a different means for pivoting a two-arm roller frame to the parting means.

Embodiment of the invention illustrated in FIG. 4 is the same as the embodiment illustrated in FIG. 3 except that the pivotal connection of the arms **36*b* to the parting means 24*b* is made to an insert 37*b* secured in the wall of the parting means 24*b*. The insert 37*b* may be made of metal of somewhat L-shape with one leg extending through the wall of the parting means 24*b*** where the pivotal connection is made and extending along the wall to provide a good anchorage for the insert. The insert may be molded in place in the spreading means at the time it is molded.

Figure 5:
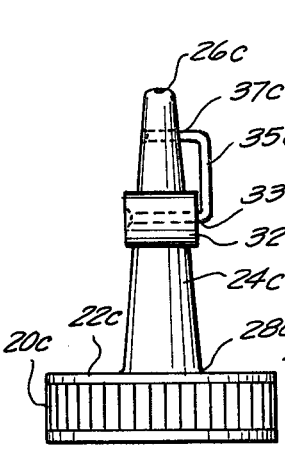
FIG. 5 is a front view similar to FIG. 3 utilizing a frame having a single arm for securing the roller to the parting means.

The embodiment of the invention illustrated in FIG. 5 is similar to the embodiment illustrated in FIG. 3 except that the frame for pivotally mounting the roller to the spreading means comprises a single arm **35*c*. Similar parts in the embodiment of FIG. 5 to the parts of the embodiment of FIG. 3 are given the same reference numerals except for the postscript c and need not be further described. The axle 33*c* for the roller 32*c* extends through the roller and is provided with some means at the free end for holding the roller on the axle. The other end of the arm 35*c* forming the pivotal connection at 37*c* also extends entirely through the spreading means 24*c* and has some means on the free end for preventing withdrawal of the frame from the tip. The roller in the embodiment of the invention illustrated in FIG. 5 is used in the same way the roller 32*a* in the embodiment of FIG. 3** which has already been described.

Figure 6:
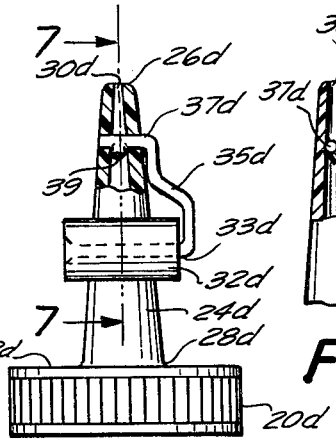
FIG. 6 is a front view, partly in section, of an embodiment similar to FIG. 5 having the added feature of stop means to limit the rotation of the arm around its pivotal mounting in the parting means.
Figure 7:
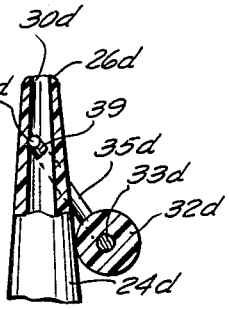
FIG. 7 is a partial sectional view along the line 7—7 of FIG. 6.

The embodiment of the invention illustrated in FIGS. 6 and 7 is similar to that of the embodiment illustrated in FIG. 5 and the parts that are the same in the two embodiments have the same reference numerals except for the postscripts c and d, respectively. The embodiment of FIG. 6 has one feature in addition to the structure illustrated in FIG. 5 which is a means for limiting the swinging motion of the arm **35*d*. At one extreme of the swinging motion in a downward direction, the rotation of the frame holding the roller is limited by the contact of the roller with the spreading means. The part of the arm 35*d* forming the pivotal connection with the spreading means 24*d* is provided with an extension 39 which contacts the wall of spreading means 24*d* within the passage 30*d* when the roller is raised through approximately 180° to the upper position beyond the end of the tip 26*d*. This enables the operator using the device to exert pressure by the roller 32*d*** against the hair of the person receiving hair treating liquid squirted from the end of the parting means during the hair color altering operation.

Figure 8:
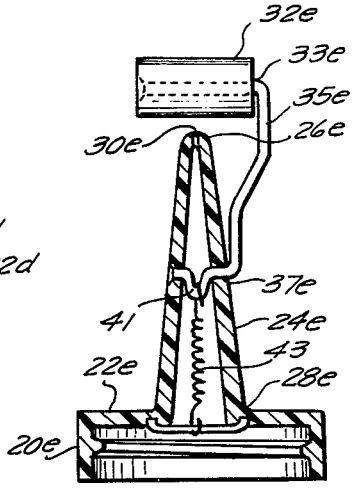
FIG. 8 is a vertical sectional view, showing a frame having a single arm rotatably mounted in the parting means for holding a roller and having spring means for yielding holding the roller adjacent to the end of the parting means.

The embodiment of the invention illustrated in FIG. 8 is similar to the embodiment of FIGS. 3, 5 and 6 and parts having the same structure are given the reference numerals with the postscript e. The embodiment of the invention illustrated in FIG. 8 adds means for yieldingly positioning the roller **32*e* in the position just behond the tip 26*e*. In this embodiment the arm 35*e* is extended beyond the part forming the pivotal connection 37*e* to form a crank arm 41 which is connected to the closure 22*e* by a tension spring 43. This structure permits the roller 32*e* to be moved out of the way of the parting means 24*a*** at the time it is used to make a parting in the hair of the person receiving a color altering treatment but to return and provide yielding pressure on the roller against the hair during the liquid spreading operation as the device is moved in the way described hereinabove to spread liquid along the hair part line or other place where the application of the liquid is desired.

Figure 9:
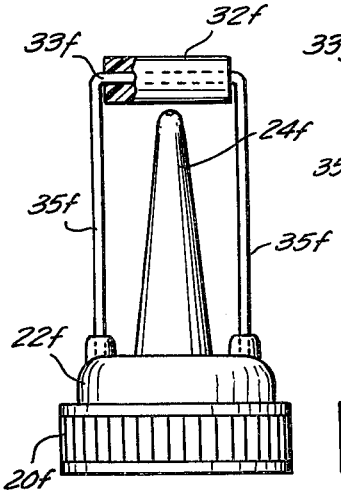
FIG. 9 is a front view of a further embodiment of the invention using two flexible arms mounted in a cap for a squeeze bottle which are adapted to yieldingly hold a roller adjacent to the end of the parting means.

The embodiment of the invention illustrated in FIG. 9 provides a similar yieldable mounting for roller **32*f* to that just described for the embodiment of the invention illustrated in FIG. 8. In this embodiment the collar 20*f* has a closure 22*f* somewhat thicker than the closure illustrated in the previously described embodiments so as to provide an anchorage for the frame carrying the roller, which comprises two flexible arms 35*f*, at one end thereof. The other end of the arms 35 is bent inwardly to provide the axle 33*f* for the roller. The arms 35*f* are made of spring wire which tend to locate the roller 32f directly in the axis of the parting means 24f in its normal position but the roller can be yieldingly moved out of the way of the parting means 24f** when it is desired to make a parting in the hair but it swings back to apply pressure on the liquid during the spreading movement as described hereinabove.

Figure 10:
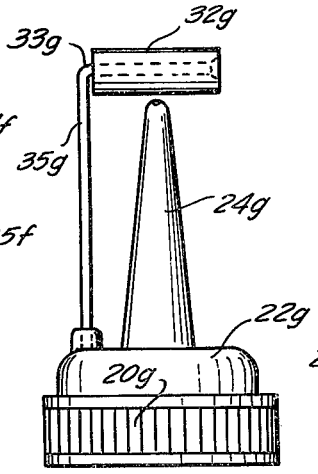
FIG. 10 is a view similar to FIG. 9 utilizing a single arm for holding the roller as described.

The embodiment of the invention illustrated in FIG. 10 is similar to that illustrated in FIG. 9 except that the frame for holding the roller 32g comprises a single arm 35g suitably mounted at the end opposite the axle 33g in the closure 22g.

Figure 11:
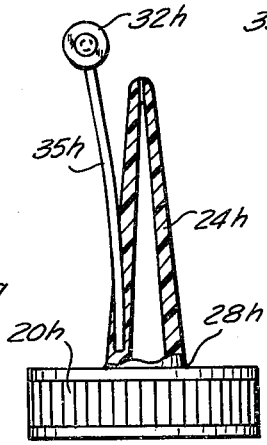
FIG. 11 is a side view illustrating another method of utilizing a single flexible arm for mounting a roller in a position offset from the parting means.
Figure 12:
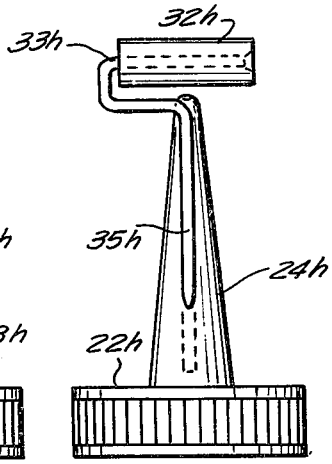
FIG. 12 is a front view of the embodiment of FIG. 11.

The embodiment of the invention illustrated in FIGS. 11 and 12 is similar to that of FIG. 10 except that the single spring arm 35h is bent so as to align the major portion thereof with the axis of the spreading means 24h as seen from the front (FIG. 12). In this embodiment the lower end of the spring arm 35h is mounted in the wall of the spreading means 24h instead of being mounted directly in the closure 22h. In this embodiment the roller 32h is beyond the tip 26h but the normal location of the roller is out of alignment with the axis of the spreading means 24h as seen in side view (FIG. 11). This permits the parting means 24h to be used without interference for effecting partings in the hair of the person receiving the color altering treatment but it is available by tilting the device sufficiently to bring the roller into contact with the liquid to spread it as desired on the hair.

Figure 13:
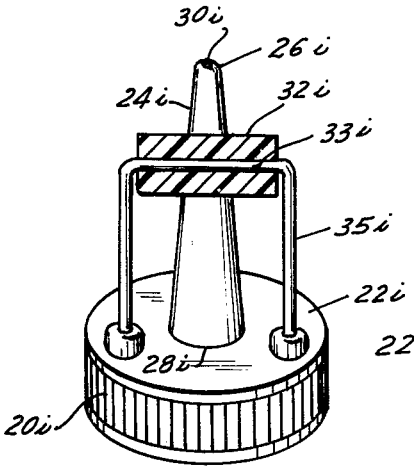
FIG. 13 is a view similar to FIG. 9 in which the arms forming the axle for the roller are shorter and place the roller at an intermediate position along the length of the parting means.
Figure 14:
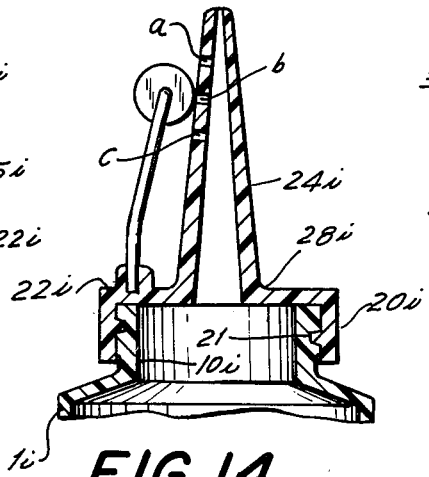
FIG. 14 is a sectional view of the embodiment of FIG. 13.

The embodiment of the invention illustrated in FIGS. 13 and 14 is similar to the embodiment illustrated in FIG. 9 except that the length of the arms 35i is such as to position the roller 32i at a location between the tip 26i and the base 28i of the parting means 24i. With the roller 32i in this location, the parting means 24i can be used to effect partings in the hair of the person receiving color altering treatment without interference from the spreading means but the spreading means is available for spreading liquid either after it has been deposited on the hair or during the deposition thereof. In order to enable the roller 32i to spread the liquid at the time it is being dispensed, a discharge orifice is provided in the wall of the spreading means 24i at a suitable location or near the roller 32i. FIG. 14 shows three posible locations for the discharge orifice 38i. One of these locations indicated by the letter a is just beyond the location of the roller. Another possible location is indicated by the letter b which is at the point where the roller contacts the spreading means. A third possible location is illustrated by letter c which is inwardly of the place where the roller contacts the spreading means. Each of these locations has advantages under certain circumstances and while one, two or three of these openings may be provided without any control whatsoever of the discharge of the liquid through each opening provided, the invention also contemplates the provision of valve means for controlling the opening and closing of these discharge outlets to enable the operator selectively to discharge liquid from any one or more of them as desired for the particular application of the hair color altering liquid being carried out at the time.

FIG. 14 also shows in section the preferred connection of a squeeze bottle 1i to a cap of the type described by means of threads 21.

Figure 15:
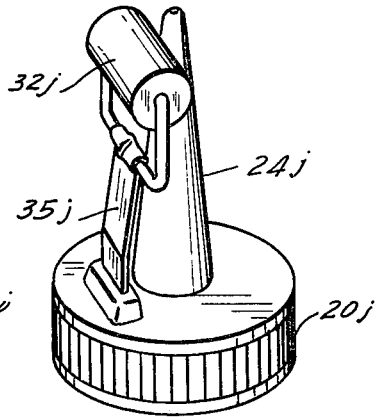
FIG. 15 is an isometric view of a modified mounting for a roller utilizing a single flexible arm having a bifurcated end to provide an axle for a roller.

The embodiment of the invention illustrated in FIG. 15 is similar to that of FIGS. 13 and 14 except that the frame for supporting the roller comprises a single leaf spring 35j having a bifurcated upper end extending outwardly on each side, then upwardly, then inwardly to form the axle for the roller 32j.

Figure 16:
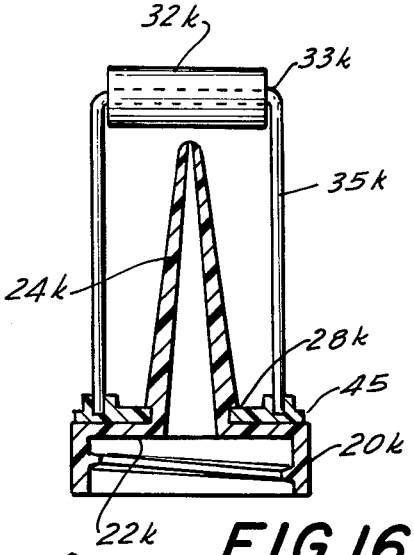
FIG. 16 is a view similar to FIG. 9 in which the framefor the roller is mounted on a turntable.

The embodiment of the invention illustrated in FIG. 16 is similar to the embodiment illustrated in FIG. 9 except that the arms 35k are mounted in a turn table 45 on the closure 22k in the form of annulus surrounding the base 28k of the parting means 24k held thereon by means of a shallow groove in the base, as illustrated. Otherwise the parts are the same as described and have been given the same reference numerals with the postscript k.

Figure 17:
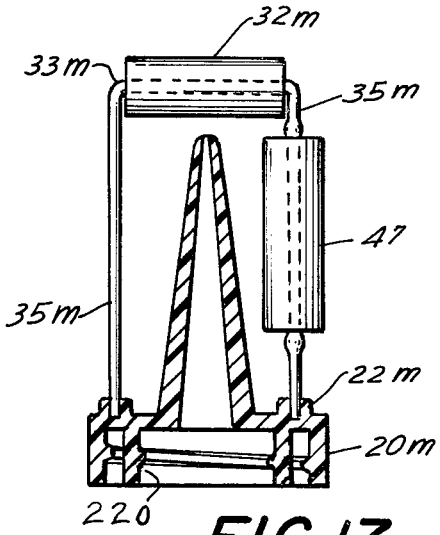
FIG. 17 is a front view of an embodiment of the invention similar to FIGS. 9 and 16 in which a further roller is mounted on at least one of the arms.

The embodiment of the invention illustrated in FIG. 17 is the same as the embodiment illustrated in FIG. 9 except for the addition of a further spreading means on at least one of the arms 35m of the frame which holds the roller 32m. This additional spreading means is illustrated in the form of a roller 47 rotatably mounted on the arm 35m at the right of this figure. A similar roller may also be provided on the other arm, if desired. This auxillary roller may be used for spreading liquid on the strands of the hair adjacent to a part without having to turn the squeeze bottle as would be necessary if the roller 32m were to be used in the same manner contemplated for the roller 47.

Figure 18:
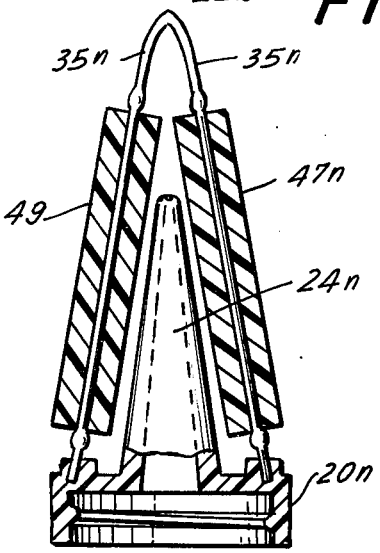
FIG. 18 is a front view, partially in section, of a still further embodiment of the invention in which the frame for the rollers is in the shape of an A having a roller rotatably mounted on each arm.

The embodiment of the invention illustrated in FIG. 18 differs from the embodiment of FIG. 9 in that the roller 32f is not used and the arms 35n which are embedded at one end in the closure 22n come together in a point normally lying in the axis of the spreading means 24n. A roller 47n is rotatably mounted on one of the arms 35n and a similar roller 49 is mounted on the other. The frame comprising the arms 35n can be moved out of the way of the parting means 24n when it is used for making a parting in the hair of the person receiving color altering treatment in the manner already described but the flexible arms will bring the rollers back into position shown when pressure moving the frame out of this position has been released to that these rollers can be used in the manner described for the roller 47 in FIG. 17.

Figure 19:
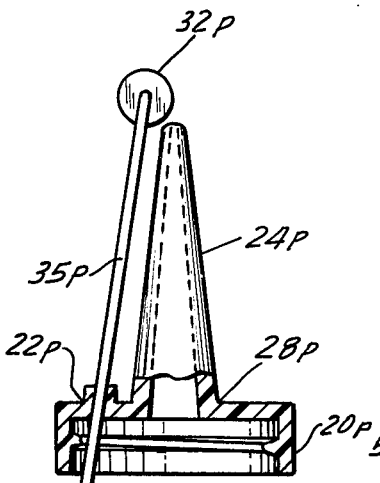
FIG. 19 is a side view of a device similar to the embodiment illustrated in FIG. 9 in which the arm is slidably mounted in the cap so that the roller can be positioned either beyond the tip as in FIGS. 9 and 17 or at an intermediate position as shown in FIGS. 13 and 14.

The embodiment of the invention illustrated in FIG. 19 is similar to the embodiment illustrated in FIGS. 9 and 13 except that in this case the lower end of the spring member 35p is slidably mounted in the closure 22p, which may be thickened at the place of the slidable connection, if desired, as shown, so that the position of the roller 32p may be adjusted from a position just beyond the tip 26p to any desired intermediate position even going down to the closure 22p.

Figure 20:
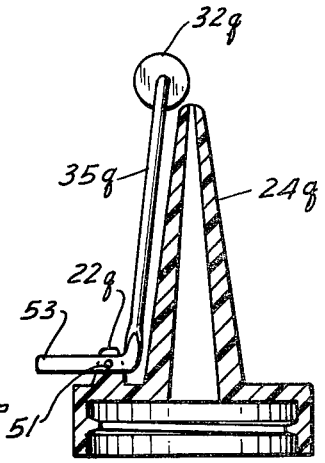
FIG. 20 is a sectional view of a device illustrating a further embodiment of the invention in which the arm (or arms) for carrying the roller is pivotally mounted on the cap.

The embodiment of the invention illustrated in FIG. 20 is analogous to that illustrated in FIG. 15 except that the arm 35q is made in the form of a bell crank which is pivoted at 51 to the cosure 22q thus providing a finger or thumb piece 53 that can be used for moving the roller 32q out of alignment with the axis of parting means 24q by simply pressing on the end of the bell crank 53. If desired, spring means may be provided for yieldingly holding roller 32q normally in the position illustrated in FIG. 20.

Figure 21:
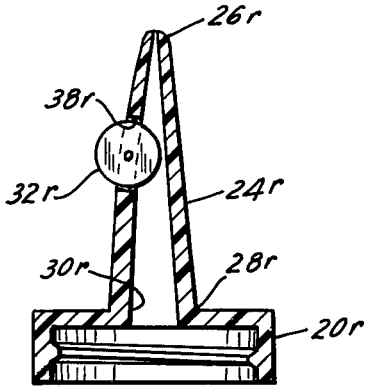
FIG. 21 is a sectional view of a still further embodiment of the invention in which the roller is mounted in an enlargement of the parting means at an intermediate position.
Figure 22:
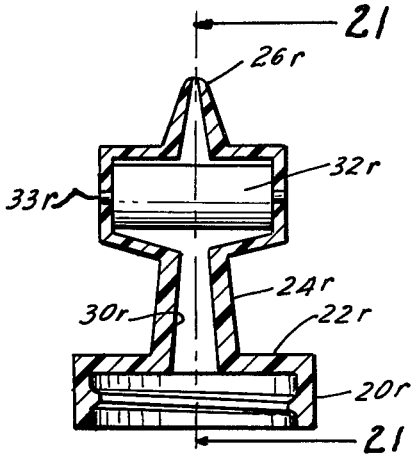
FIG. 22 is a sectional view of the device of FIG. 21 taken at right angles to that of FIG. 21 which is taken along the line 21—21 of FIG. 22.

In the embodiment of the invention illustrated in FIGS. 21 and 22, the parting means 24r is broadened at an intermediate location to provide journals for the axle 33r used to mount the roller 32r directly in the spreading means. The portion of the spreading means 24r from the enlargement to the tip 26r enables the device to serve for making parts in the hair of the person receiving color altering treatment and the color altering liquid can be supplied from the squeeze bottle to be screwed onto the cap, as illustrated, can be applied to the hair through the passageway 30r either through the tip 26r, if the roller 32r has practically fluid tight engagement with the adjacent parts of the walls of the spreading means 24 or, the walls of the enlargement of the spreading means 24a can be spaced from one or both sides of the roller 32r far enough to provide orifices 38r through which the liquid may be dispensed. Otherwise the parts of this embodiment correspond to the parts of previously described embodiments and have the same reference numerals with the postscript r.

Figure 23:
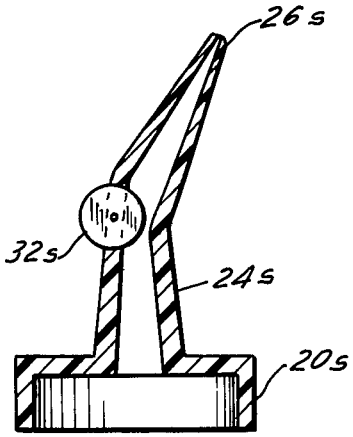
FIG. 23 is a sectional view similar to FIG. 21 illustrating a different angle of the parting means beyond the enlargement for the roller.

The embodiment of the invention illustrated in FIG. 23 differs from the embodiment illustrated in FIGS. 21 and 22 only in the angular relation of the end of the spreading means beyond the enlargement which provides the pivotal mounting for the roller 32s. The axis of the upper part of the spreading means in this embodiment forms an obtuse angle with the axis of the lower part of the spreading means instead of being aigned therewith which makes the roller 32s somewhat more readily available for the spreading operation than in the embodiment of FIGS. 21 and 22 because the angle of the squeeze bottle, when secured to the cap as described, can move through a number of degrees of angular rotation around the pivot point of roller 32s when the upper part of the spreading means has the angular relation to the lower part, as opposed to the straight relation in FIGS. 21 and 22.

Otherwise the parts of FIG. 23 correspond to the parts of the other embodiments previously described and have been given the same reference numerals with the addition of postscript s.

Figure 24:
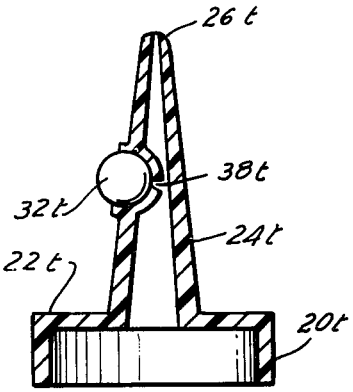
FIG. 24 is a view similar to that of FIG. 21 in which a ball is utilized in place of a roller.

The embodiment of the invention illustrated in FIG. 24 is similar to that of the embodiment disclosed in FIGs. 21 and 22 except that a ball 32t is used in place of a roller. In this embodiment of the invention the color altering liquid may be dispensed from the tip 26t or from an orifice 38t formed in the spherical surface of the socket receiving the ball 32i t. Otherwise this embodiment comprises the same parts as the embodiment of FIGS. 21 and 22 and similar parts bear similar reference numerals with the postscript t.

Figure 25:
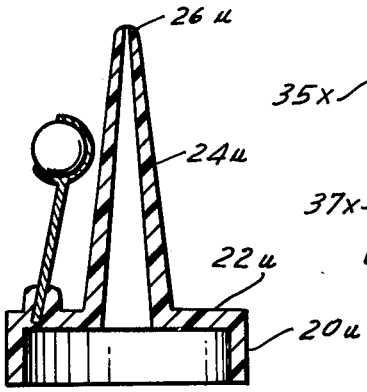
FIG. 25 illustrates an embodiment of the invention similar to that of FIG. 15 in which a ball is used in place of a roller.

FIG. 25 illustrates an embodiment of the invention similar to that of FIG. 15 except that the spring 35u is provided with a socket to receive a ball 32u instead of having the bifurcated ends to provide the mounting for a roller. Otherwise the embodiment of FIG. 25 is the same as that of FIG. 15 and has been given the same reference numerals except for the postscript u.

Figure 26:
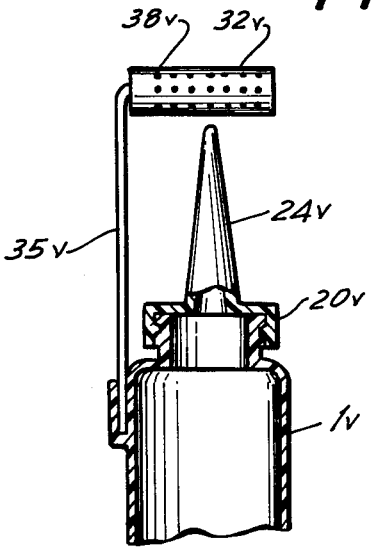
FIG. 26 is a device similar to that of FIG. 10 in which the arm is mounted on the squeeze bottle instead of the cap.

The embodiment of the invention in FIG. 26 is similar to the embodiment of FIG. 10 except that the spring arm 35v is mounted in the wall of the squeeze bottle 1v instead of being mounted in the closure of the cap 20v. Otherwise the parts of this embodiment correspond to the parts of the embodiment in FIG. 10 and have been given the same reference numerals except for the postscript v.

If desired, arm 35v may be provided with liquid passage that communicates at the lower or bottle end through a liquid passage through the wall of the bottle into the socket in which that end of arm 35v is tightly held and at the upper end this passage may communicate with a chamber in roller 32v from which a number of liquid discharge passages 38v lead to the cylindrical surface of the roller. When arm 35v and associated parts are constructed in this manner, the embodiment of FIG. 26 is quite similar to the embodiment of FIG. 27 except for the location of the socket for the bottle end of arm 35v.

Figure 27:
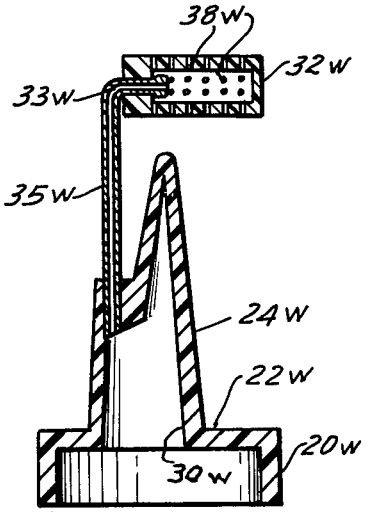
FIG. 27 shows an embodiment of the invention in which the roller is mounted on the parting means by a single hollow arm through which color altering liquid may be fed into the hollow roller for dispensing the liquid through the roller.

The embodiment of the invention illustrated in FIG. 27 is somewhat similar to the embodiment illustrated in FIGS. 11 and 12 in that the arm 35w is secured at the lower end in the wall of the parting means 24w and is otherwise similar to the modification of FIG. 26 just described in that the arm 35w is hollow providing a passage which communicates with the passage 30w and also communicates through the axle 33w with the interior of a hollow roller 32w which has a plurality of orifices 38w in the cylindrical surface thereof. These embodiments of the invention permit the operator to dispense from the squeeze bottle to be secured to the collar 20v or 20w directly onto the hair from the roller 32v or 32w.

Figure 28:
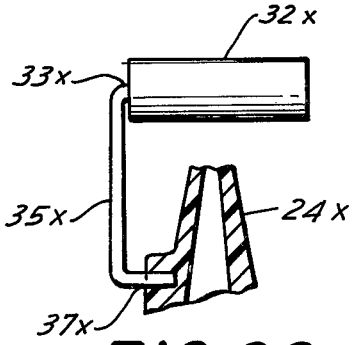
FIG. 28 is a view similar to FIG. 5 in which the roller is mounted on a single arm secured in an enlargement on the side of the parting means.

FIG. 28 discloses another embodiment of the invention in which the parting means 24x has an enlargement in the wall at one side thereof to receive an end 37x of the arm 35x which is generally U-shaped in side view as seen in FIG. 28, with one end of the U connected to the parting means as described at 37x while the other end forms an axle 33x on which roller 32x is rotatably mounted. This form of the invention is quite similar to that of FIGS. 5, 6 and 8 but instead of being freely movable around the connection 37x, it may be relatively fixed in position, if desired.

Figure 29:
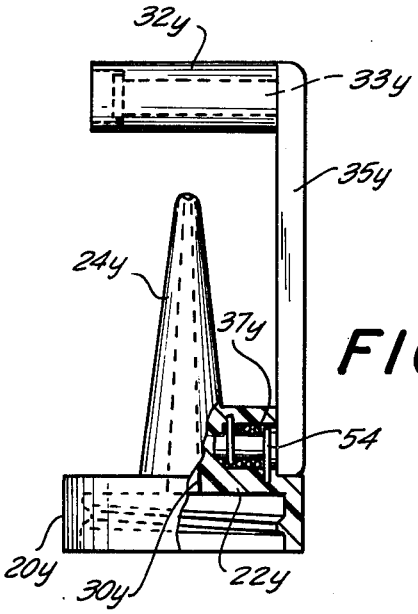
FIG. 29 is a front view of a device embodying the invention utilizing a single arm for mounting a roller adjacent to the tip of the parting means and having a spring biased pivotal connection to the parting means adjacent to the base thereof.

The embodiment of FIG. 29 is somewhat similar to that of FIG. 28 in that the cap 20y has an enlargement at the base of the parting tool 24y to receive a shaft 37y connected to the lower end of the arm 35y on which a roller 32y is rotatably mounted on axle 33y at the upper end of the arm. In this embodiment of the invention a spring 54 is provided to bias the arm 35y and the associated roller 32y to the upright position shown in FIG. 29. When the device of FIG. 29 is in practical use, the roller 32y can be moved out of the position shown to clear the end of the parting means 24y to make a parting in the hair simply by pressing the roller against the hair. This causes the arm 35y to swing around the shaft 37y against the force of the spring 54 so as to be out of the way while the parting is being made. As soon as the parting tool 24y is lifted from the scalp, the roller 32y springs back into position where it may be used to spread liquid discharged through the passageway 30y in the parting tool 24y.

Figure 30:
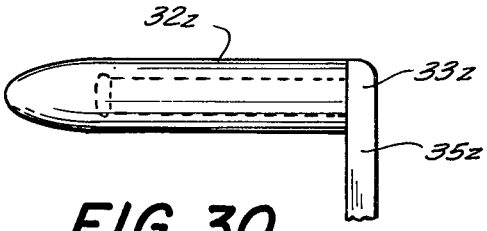
FIG. 30 is a fragmentary view of a device similar to that of FIG. 29 in which the roller has a sharpened end opposite the mounting arm.

The embodiment in FIG. 30 differs from that in FIG. 29 only in that the roller 32z is sharpened at the end opposite the arm 35z so that it to may serve as a parting tool, if it is desired to use it for this purpose. This shape has advantages in certain circumstances and the invention contemplates that the roller may be sharpened, as shown in FIG. 30, in any embodiment having a single arm mounting it on the cap or bottle, as in FIGS. 5, 6, 7, 8, 10, 12, 26, 27 and 28 so as to serve not only for spreading the liquid but also for making partings.

Figure 32:
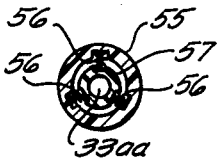
FIG. 32 is a sectional view of the device of FIG. 31 along the line 32—32 thereof.
Figure 31:
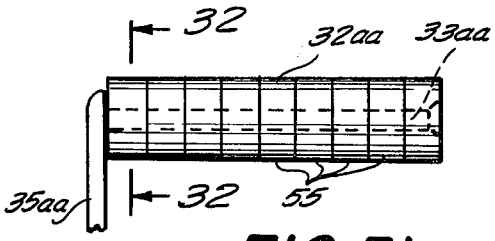
FIG. 31 is an elevational view of a sectional roller having means enabling the sections to adapt to a contour of the surface over which the roller is being rolled.

The embodiment illustrated in FIGS. 31 and 32 is a roller construction which may be used in any of the embodiment heretofore described. In this embodiment the roller is divided into a plurality of individual rings 55 which, when assembled, constitute a roller of the desired length in accordance with any of these embodiments. Each ring is individually supported by three or more springs 56 from a central cylinder 57 surrounding and rotatable upon the axle 33aa. This enables the roller to adapt itself to the contour of the surface over which it is being rolled for the purpose of spreading liquid.

Figure 33:
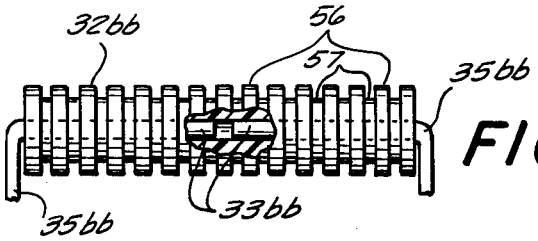
FIG. 33 is an elevational view of a different embodiment of grooved roller showing the structure of the axle in the embodiments of FIGS. 9, 16 and 17.

FIG. 33 discloses a further embodiment of roller which may likewise be used in each of the embodiments of the invention described hereinabove. In this instance the peripheral surface of the roller comprises a plurality of larger diameter rings 56 and a plurality of smaller diameter rings 57, and the roller **32*bb* is rotatably mounted on the axles 33*bb* of the supporting frame 35*bb*. The roller 32*bb* may be made of individual rings of the two different diameters or the rings may be formed in the surface of a single piece roller by turning or otherwise forming grooves at the periphery of the smaller rings 57 while leaving the outside diameter unchanged at the places where the larger rings 56** are provided. In either construction the roller surface comprises ridges and grooves which increase the surface area and assist in carrying liquid into the hair in the spreading operation.

Figure 34:
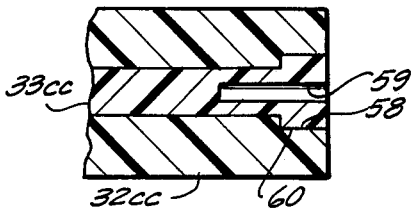
FIG. 34 is a fragmentary sectional view showing one means for securing a roller on the axle of a frame having a single arm connecting the roller to the device.

FIG. 34 illustrates one means that may be used for mounting a roller **32*cc* on a shaft or axle 33*cc* in such a way as to prevent the roller from running off the end of the axle 33*cc* when it is being used for spreading liquid. The means disclosed comprises an enlargement 58 at the free end of the axle 33*c* in the form of a ring shaped annulus which is provided with a kerf 59 extending axially into the end of the axle far enough beyond the enlargement 58 that the two ends thus formed by the kerf may be moved toward each other to clear the shoulder of the enlargement 58 from a shoulder in the roller formed by an enlargement 60 corresponding in shape and size with the the enlargement 58 when it is in the normal position as shown in FIG. 34. Therefore by simply squeezing the two parts of the end of the shaft 33*c*** toward each other the retaining means that keeps the roller on the shaft is released so that the roller can be pulled off by moving it to the right as seen in FIG. 34.

FIG. 35 discloses a form of spreading means which does not interfere with the use of the frusto-conical parting means **24*cc* as a parting tool. This embodiment of the invention includes a squeeze bottle 1*cc* having a neck 10*cc* having removably secured thereto a cap or applicator having a flange 20*cc* and a closing means 22*cc* to make liquid tight contact thereof with the squeeze bottle. A liquid passageway 30*cc* extends from the closure means 22*cc* to discharge orifice 38*cc* in a spreading means 32*cc* formed on one side of the parting tool 24*cc*. The spreading means 32*cc* is in the form of a spatula extending backward from the free end 26*cc* of the parting tool a substantial distance, e.g., about ⅓ of the length of the parting tool. Spreading means 32*cc* is adapted to spread liquid by moving the parting tool 24*cc* laterally across the stream of liquid discharged from the orifice 38*cc* and lengthwise of the hair adjacent to the part or elsewhere. In the use of this device, e.g., for touch up, this stream of liquid is forced from the squeeze bottle by pressure generated by squeezing it with the hand that holds it and the stream of liquid is laid down by moving the parting tool along the part of the hair at the roots thereof. This liquid is then spread into the hair adjacent to the part by moving the spatula 32*cc*** with the same hand transversely away from the part outwardly along the hair with the edge of the spatula contacting the hair until it reaches the area of the new growth.

FIG. 36 illustrates the further embodiment of hair treatment device in which the parting means **24*dd* is made in two parts. One part 61 is secured in the usual way to the closure means 22*dd* and terminates at the other end in a roller or a ball 62. The other part 63 is sharpened at the outer end and provided with a socket 64 on the inner end which engages the roller or ball 62 over somewhat more than a hemicylinder or hemisphere to hold the parts in assembled relation. By making the socket portion of the part 63 of an elastomeric material, it has enough give to permit assemblage while leaving the fit loose enough for adjusting the angle of the outer part 63 with respect to the inner part 61 to any desired extent. The outer end of the liquid passageway 30*dd* ends in a discharge orifice 38*dd* which can communicate with a slot or groove 65 in the socket 64**.

If desired, the length of the slot 65 may be such that the discharge orifice 38 is closed when the outer member 63 is axially aligned with the inner member 61 but be opened for discharge when they are angularly related as illustrated in FIG. 36.

FIGS. 37 and 38 illustrate a further embodiment of the invention similar to that of FIG. 36 except that a spring 66 is connected at one end to the outer member **63*a* and at the inner end to the enlargement 62*a*. The spring 66 is a tension spring strong enough to bring the parts to the axial alignment shown in FIG. 37 wherever the parts are free to move to their normal positions. On the other hand if pressure is exerted against the outer end of member 63 it can be moved angularly with respect to the part 61*a* as shown in FIG. 38, thereby putting the spring 66 under sufficient tension to bring the parts back to the relationship shown in FIG. 37 when the pressure on the outer member 63*a* is released. As shown in FIGS. 37 and 38, the discharge orifice 38*ee* may be closed by the socket member 64*a* in the normal position but be brought into communication with the groove 65*a*** when the outer member is moved angularly to the position shown in FIG. 38.

Figure 39:
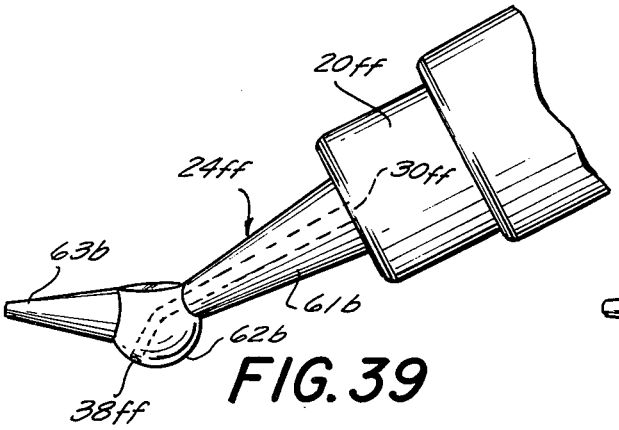

The embodiment of the invention illustrated in FIG. 39 is similar to that of FIGS. 36, 37 and 38 except that the parting tool **24*ff* is made of a single part rather than two parts and the axis of part 63*b* bears a fixed angular relation to the axis of part 61*b*. In other words, the inner part 61*b* is integral with the enlargement 62*b* which in turn is integral with the outer part 63*b* and the discharge orifice 38*ff* for the liquid passageway 30*f* is located in essentially the same position that 38*ee*** occupies in FIG. 38.

Figure 40:
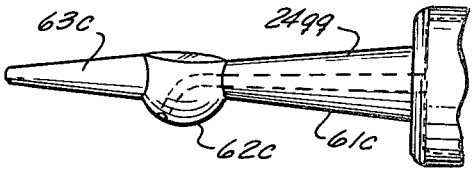

FIG. 40 is an embodiment quite similar to that of FIG. 39 except that the outer part **63*c* of the parting tool 24*gg* is axially alligned with the inner part 61*cc*** instead of being angularly related thereto as in the embodiment of FIG. 39.

The embodiment of FIG. 41 is quite similar to that of FIG. 39 except that the inner part **61*d* is made separate from the frusto-conical parting tool 24*hh* and is provided with a recess conforming in shape with the parting tool 24*hh* over which it may be slipped and frictionally held as shown in FIG. 41. In this embodiment of the invention the parting and spreading means 61*d*, 62*d*, 63*d*** is an attachment to a cap or applicator of the usual type to convert it into the special parting and spreading means of the invention. Those skilled in the art will recognize that the parting and spreading means of any of the embodiments heretofore described may be made in the form of an attachment essentially as illustrated in FIGS. 35 to 49, all of which the present invention contemplates.

Figure 42:
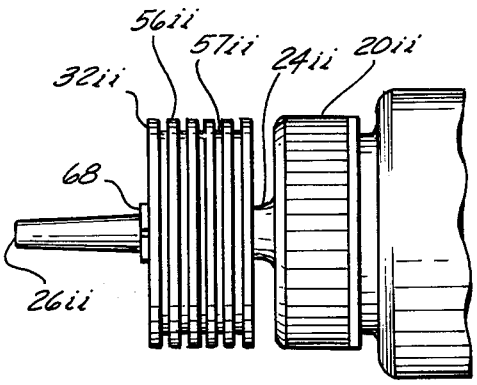
FIG. 42 is a fragmentary side view of a further hair treatment device embodying the invention with a still different species of roller spreading means.

FIG. 42 illustrates another parting and spreading device embodying the present invention in which a cap **20*ii* is provided having a frusto-conical parting tool 24*ii* secured thereto. Rotatably mounted on the parting tool 24*ii* is a roller 32*ii* which may, if desired, by provided with peripheral grooves 57***ii* leaving rolling and spreading surfaces 56*ii* of larger diameter. In this embodiment of the invention the liquid may be discharged either from the outer end 26*ii* of the parting means 24*ii* or the roller 32*ii* may be provided with discharge orifices analogous to those illustrated in FIG. 27. The roller 32*ii* may be held in position on the parting means 24*ii* by means of split ring 68 and a corresponding groove in the outer surface of the parting means 24*ii* at the place illustrated in FIG. 42.

Figure 43:
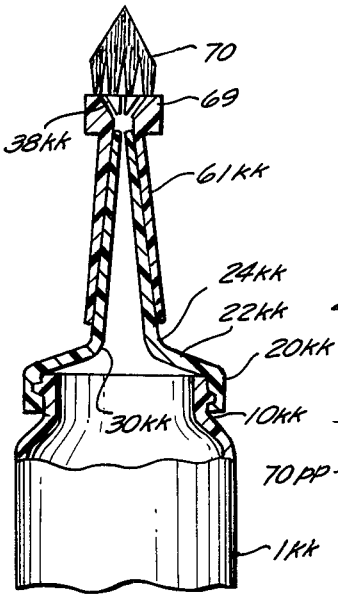
FIG. 43 is a fragmentary side view partially in longitudinal section, of a hair treatment device illustrating a still further embodiment of the invention which can be used to spread hair color altering liquids.

FIG. 43 illustrated another form of spreading means according to the invention in which a squeeze bottle 1*kk* having a neck 10*kk* is provided with a cap 20*kk* having a closing means 22*kk* secured thereto on which a parting means 24*kk* is integrally secured. Member 24*kk* is preferably frusto-conical in shape to receive an attachment having a frusto-conical recess in a sleeve member 61*kk* which forms a tight frictional contact with the member 24*kk* as shown. The attachment has the spreading means secured thereto in any convenient placed and the spreading means may be of any desired structure. One form of spreading means comprises a base 69 integral with the attachment for holding a plurality of tufts of bristles 70. These bristles may have any desired length and contour but a preferred shape is the somewhat pointed contour illustrated. The brush base 69 is provided with one or more discharge passageways 38*kk* to discharge liquid from the squeeze bottle 1*kk* into the hair where it may be spread with the brush 70.

Figure 44:
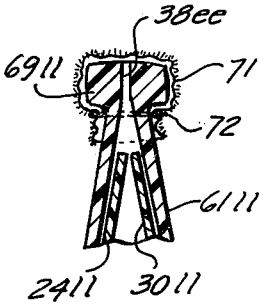
FIGS. 44, 45 and 46 are fragmentary longitudinal sectional views of devices illustrating modifications of the embodiment illustrated in FIG. 43.

The embodiment of the invention shown in FIG. 44 is quite similar to that shown in FIG. 43 except that the bristles are replaced by an applicator cloth 71 held on the enlargement 69*ll* by a tie means 72. This applicator may be in the form of terrycloth, or the like, which is pervious to liquid squeezed from the passageway 30*ll* so that the liquid can be discharged into the hair and spread by movements of the spreading means 71 from the scalp outwardly along the hair.

Figure 45:
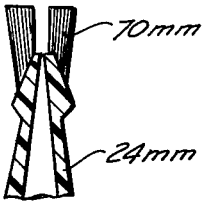

The embodiment of FIG. 45 is also similar to FIG. 43 except that the bristles are mounted directly in the means 24*mm*, as shown at 70*mm*, instead of being mounted separately in an attachment.

Figure 46:
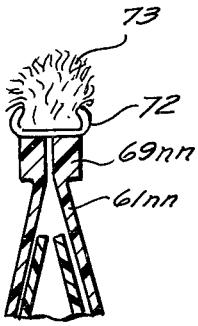

The embodiment of FIG. 46 is quite similar to that of FIG. 44 except that instead of providing a terrycloth or like spreading means, a channel shaped member 72 is mounted on the enlargement 69*nn* with arms that engage and hold a spreading means 73 therein which may be cotton batting or the like.

In the devices of FIGS. 43 through 46 the frusto-conical parting means may be used for this purpose simply by pulling off the attachment and then replacing it for spreading liquid or a parting tool may be provided elsewhere, if desired, e.g., on the other end of the squeeze bottle, on the attachment, e.g., with its axis at right angles to the axis of the frusto-conical recess, or the like.

Figure 47:
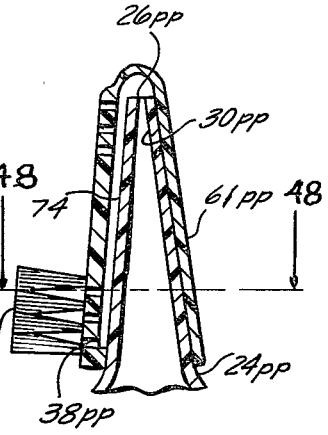
FIG. 47 is a fragmentary longitudinal sectional view of a device illustrating still a further embodiment of the invention which can be used to spread color altering liquids.
Figure 48:
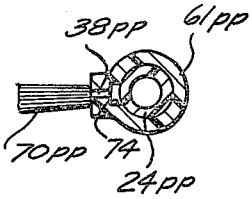
FIG. 48 is a sectional view of the device of FIG. 47 along the line 48—48.

The embodiment of the invention shown in FIGS. 47 and 48 is similar to that of FIG. 43 in that the spreading means is secured to an attachment 61*pp* but in this embodiment of the invention the bristles are secured along the frusto-conical surface so that the brush for spreading the liquid is on the side of the parting means instead of the end thereof. This enables the attachment 61*pp* to serve more effectively as a parting means while the spreading means 70 is equally as efficient on the side as it is on the end. In order to provide liquid at the base of the spreading means 70*pp*, a groove 74 may be provided in the frusto-conical recess at one side to conduct liquid from the end of the liquid passageway 30*pp* through the end 26*pp* and then along the frusto-conical member 24*pp* to the discharge orifices 38*pp* at the base of the bristles 70*pp*.

Figure 49:
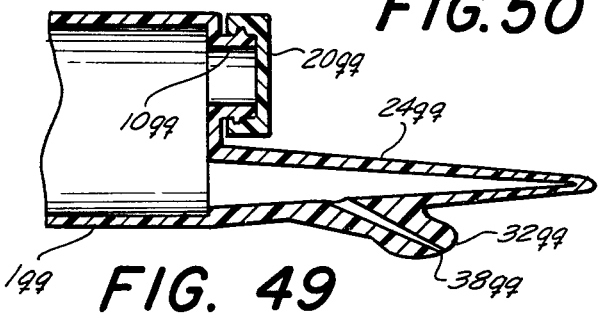
FIG. 49 is a fragmentary sectional view of a squeeze bottle having a tip formed directly thereon.

The embodiment of the invention in FIG. 49 is quite similar to the embodiment of FIG. 1 except that the parting means 24*qq* is made integral with the squeeze bottle 1*qq* and the bottle is provided with a separate neck 10*qq* suitably closed by a cap 20*qq*. The device of FIG. 49 can be used in exactly the same way as the device of FIGS. 1 and 2. The anglular relation of the axis of parting means 24*qq* with respect to the axis of the bottle 1*qq* may be straight, i.e., these axes may be parallel to each other, or obtuse, e.g., as in FIG. 1, of any desired degree.

Figure 50:
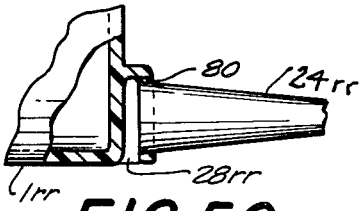
FIG. 50 is a fragmentary view, partially in section, of an embodiment of the invention similar to that of FIG. 49 except the parting means is made separable from the squeeze bottle.

The embodiment of the invention shown in FIG. 50 is quite similar to that of the embodiment of that shown in FIG. 49 except that the parting member 24*rr* (shown only fragmentarily) is made separate from the squeeze bottle 1*rr*. The joint to hold them in separable relation may be made in any desired way but that illustrated FIG. 50 is very simple yet effective. It comprises providing a ring 28*rr* at the base of parting member 24*rr* which is held by a wall 80 integral with the end of the squeeze bottle 1*rr* and which straddles the parting means 24*rr* while it engages the enlarged base 28*rr* and holds it in position as shown in FIG. 50.

FIG. 51 illustrates a still further embodiment of the invention in which a cap member 20*ss*, which is secured to the squeeze bottle 1*ss* in any suitable manner, is provided with a pivoted parting tool 24*ss* that may be (a) moved outwardly to the position shown in FIG. 51 in which a liquid passageway 30*ss* is opened from the squeeze bottle to the discharge orifice 38*ss* or (b) moved inwardly to closed position as indicated by the arcuate arrow in which position the discharge passageway 30*ss* is closed to the discharge of liquid. To the cap 20*ss* is secured a roller 32*ss* by means of a pair of holding members 35*ss* preferably molded integral with the cap 20*ss*. This form of the device permits the shipment of liquids in the cap by simply moving the parting tool 24*ss* to closed position and screwing the cap on the neck to a liquid tight relation.

FIG. 52 illustrates an embodiment of the invention very similar to that of FIG. 51 except that the roller is mounted on the squeeze bottle 1*tt* adjacent to the neck instead of being secured to the cap, as in FIG. 51, or to other holding means as illustrated in FIG. 3 and following.

The pivotal connection of the parting tool shown in FIGS. 51 and 52 may be used in any of the other embodiments of the invention instead of the integral construction shown.

FIGS. 53 and 54 illustrate another form of parting and spreading means in accordance with the invention. This embodiment comprises a comb 82 having a handle 84, a back 86 and a plurality of tines 88, preferably of relatively coarse construction. The comb can be used in the regular way to make partings with the tines 88. The comb is provided with spreading means 90 in the form of a jacket 90 having a plurality of holes along one surface through which the tines extend as shown in FIG. 53 and fastening means 92 on the opposite side to hold the spreading means 90 around the comb as clearly seen in FIGS. 53 and 54. In use the comb may be dipped into a quantity of hair color altering liquid to saturate the jacket 90, the implement may then be used to make a parting and then to spread the contained liquid in the jacket into the hair as desired. The comb can also be run through the hair outwardly in a usual combing motion to spread hair color altering liquid lightly on the surface hair as the comb is moved along the strands.

FIGS. 55 and 56 illustrate a hair treating device comprising a clamp 140 having an elongated holding bar 141 including a plurality of transverse recesses 142 in one surface thereof, each recess being adapted to hold a strand of hair, and a clamping bar pressed against the surface having the recesses with strands of the hair in the recess to hold the clamp to the hair. A convenient way for providing the necessary pressure is by means of a hinge comprising ears 143 at one end of the bar 141 and a cylindrical enlargement 145 at the end of the bar 144 through which a hinge pin 146 is passed to provide a pivotal connection between the bar 141 and the clamping bar 144. At the other end a latch 147 is provided which may be in the form of a resilent extension from one of the bars, e.g., bar 141, at least part way across the other bar which is provided with a recess or notch to receive a latching projection 148 on the latch 147. This latch connection is sufficient to hold the bar 144 tightly against the bar 141 so as to hold the clamp in position on the hair wherever the operator places it.

FIGS. 57 and 58 illustrate a hair treating device comprising two clamps. One of them bearing reference numerals **141*b* to to 147*b* is essentially the same as the bar clamp illustrated in FIGS. 55 and 56. In this embodiment the second clamp 150, which can be of known construction, comprises a hollow bar 151 having an elastic band 152 secured at one end to the bar and with the free end having a fastening means such as a ball or the like thereon which can be slipped into recess 153** in the other end of the bar so as to hold the elastic band tightly against the bar and thereby retain it in position on the hair where an operator places it. Desirably the clamps engage the hair so tightly that seepage of flowable liquids passed them is essentially avoided.

The clamps of FIGS. 55 through 58 are especially adapted for use in the process of treating hair which involves the application of hair treating materials to the hair which should not come in contact with the scalp. An example of such a hair treating material is the pasty mixture of BASIC WHITE with a developer which is widely used for lightening hair and is known in the art as an off-the-scalp type bleaching material. The clamps 140 may be placed on strands or tresses of hair adjacent to the scalp to protect the scalp against direct application of the off-the-scalp type bleach material to it. Desirably the scalp is further protected by a sheet 149 or **149*a* of rubber or plastic which is secured to the bar 141 or 141*a*, respectively, and may be laid down over the hair as shown in FIGS. 56 and 58. It will be understood that when the off-the-scalp type bleach is spread along the strand, it will lie against the protective sheet or shield 149, or 149*a*, and will not get on the scalp or the underlying hair to provide lightening action where it is not desired. It is thus seen that clamps 141 and 141*a* and the protective shields 149 and 149*a* protect the scalp and the underlying hair from having bleach material applied thereto when the device is in place as shown in FIGS. 56 and 58. If it is desired also to limit the application of the bleach material to new growth only, as is frequently the case, the second clamp 150 is placed on the strands at the end of the new growth so that the bleach material is applied to the strands of hair between the two clamps and is prevented from contacting previously bleached and thereby weakened hair outwardly from the clamp 150** as well as protecting the scalp from contact of the bleaching material as already described.

Figure 59:
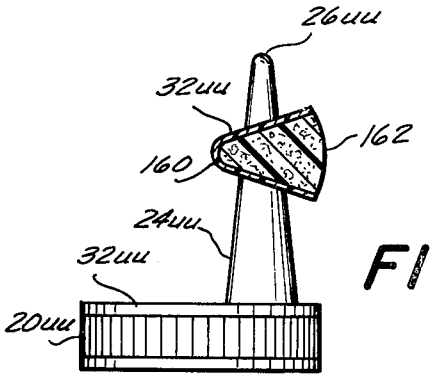
FIG. 59 illustrates a still further embodiment of parting and spreading means.

FIG. 59 illustrates a further form of parting and spreading means comprising a cap **20*uu* adapted to be secured to the neck of a squeeze bottle (not shown) and which closes the bottle by closure 22*uu* except for the liquid discharge opening (not shown) passing through the parting means 24*uu*. Mounted on the parting means 24*uu* intermediate its ends is a spreading means 32*uu* in the form of a porous sponge having a skin 160 on all surfaces except the surface 162 which faces the hair in the spreading position of the device. This device is used in much the same way as the device of FIGS. 1 and 2 by making the partings with the parting tool 24*uu*, discharging liquid through the parting tool onto the hair and then using the spreading means 32*uu* and in particular surface 162 thereof, to spread the liquid as desired into the hair. Instead of discharging the liquid from the end 26*uu*, a discharge orifice may be provided into the sponge, and if it is of the open cell type the orifice need be only in the tool 24*uu*, for discharging the liquid through the sponge material into the hair where it is spread by surface 162**.

Figure 60:
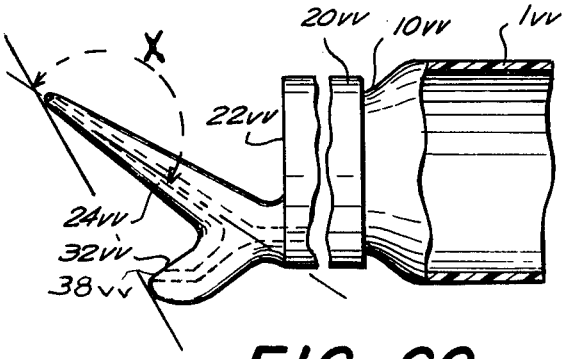
FIG. 60 illustrates a modification of the device of FIG. 1.

FIG. 60 discloses a further embodiment of the invention similar to the embodiment of FIGS. 1 and 2 comprising a squeeze bottle **1*vv* having a neck 10*vv* on which an applicator comprising a flange 20*vv* and a closure 22*vv* is held in fluid tight relation by any suitable means such as threads and the like as illustrated in FIG. 14, for example. A parting means 24*vv* is secured to the closure means 22*vv* in any suitable manner, e.g., it may be molded integral with 22*vv*, pivoted thereto as shown in FIGS. 51 and 52, slidably mounted thereon as shown in FIG. 50, molded as an attachment to a frusto-conical parting tool as illustrated in FIGS. 43, 44, 46 and 47, and the like. The angular relation of the axis of the parting tool to the axis of the bottle 1*vv* and flange 20*vv* may be straight, i.e., the axes may be parallel, or obtuse at any desired angle, usually within the range of about 135° to 180°, and the axis may be obtuse as seen from the side and straight as seen from the front or back (at right angles to the side view illustrated in FIG. 60**).

There are three features illustrated in the device of FIG. 60 which are different from the device illustrated in FIGS. 1 and 2. One feature is that the flange **20*vv* is optionally much longer than that of flange 20 in FIGS. 1 and 2. The second feature is that the spreading means 32*vv* extends substantially farther from the projection of the periphery of the flange and from the projection of the periphery of the bottle than is the case with the spreading means 32 as illustrated in FIG. 1. These features may be used on the devices individually or together, if desired. A reason why one or both of these features may be desirable is that some operators who tend to hold the squeeze bottle in the hand almost horizontally or on a tangent to the point of contact of the spreading means with the scalp may contact the head with the shoulder of the bottle as it is moved back and forth during spreading of liquid discharged from the squeeze bottle. This contact may be annoying to the customer and it almost alway results in pick-up of liquid on the bottle, which is messy and may result in application of liquid to hair where none is wanted. This tendency is greatly reduced or eliminated by making the flange 20*vv* substantially longer; also by extending the spreading means 32*vv* beyond the projection of the periphery of the bottle. A similar result is obtained by using a bottle of smaller diameter in relation to the diameter of the flange of the cap, e.g., by eliminating the shoulder and neck of the bottle and placing the threads that connect the bottle to the cap on the outside of the undiminished open end thereof. This brings the parts into about the same relative position as illustrated in FIG. 49 where the end of spreading means 32***qq* lies well outside the projection of the periphery of the bottle 1*qq*.

In FIGS. 1 and 60 the axes of the parting tools 24 and 24*vv*, respectively, are indicated by broken lines. In FIG. 1 this axis is at an obtuse angle of about 167° with respect to the axis of the squeeze bottle which is also the axis of the collar or flange 20 where it is of uniform height. In FIG. 60 the axis of the parting tool is at an obtuse angle of about 147°. Both angles are well within the preferred range of about 135° to 180° and each is very satisfactory in use. A line tangent to the upper end 34 of spreading means 32 and to the upper end 26 of the parting tool 24 is also shown in FIG. 1 and a comparable line is drawn on FIG. 60 with the angle between them marked X. This is a measure of the difference in height of these two parts and of the distance of the end 34 from the axis of the parting tool. In FIG. 1 angle X is about 135°. In FIG. 60 angle X is about 153°. For convenience in use of the device for parting hair and spreading liquid into it after discharge from a squeeze bottle, angle X is preferably within the range of about 125° to 165° but angles of fewer and greater degrees are operative.

The desired angular relation of the axis of the parting means to the axis of the bottle can be provided in a number of ways. One way, referred to hereafter as the "first" way, is to mold the device with the desired angular relation between the axis of the parting tool and the axis of the collar when it has uniform width or height and its axis of the bottle. Another way is to make the collar of the uneven height in a plane through the midpoint of the spreading means and the axis of the parting tool, e.g., wider adjacent to the parting tool and narrower 180° therefrom which has the effect of tilting the axis of the parting tool toward the axis of the bottle or, in other words, of reducing the obtuse angle between them. A similar effect can be achieved by molding the neck on the squeeze bottle with its axis on an obtuse angle to the axis of the bottle instead of being aligned therewith. The simplest way is by molding the device as described in the first way but the invention is not limited thereto and other ways are contemplated.

A third feature in FIG. 60 different from FIGS. 1 and 2 is that the discharge orifice 38*vv* is not at the point where the tangent line touches the spreading device 32*vv* but far enough away from it that a stream of liquid can be discharged through it and laid down as a line on the scalp without being immediately spread laterally. Both locations have advantages in certain operations. For example in touch up of very short new growth it may not be necessary or desirable to spread the bleach liquid whereas in applying a tint the spreading may be necessary or desirable.

Squeeze bottles are commercially supplied in 5 ounce and 8 ounce sizes with necks of different diameters. In order to make the device of the invention suitable for both sizes, two collars, such as 20*m* and 220 in FIG. 17, may be molded on a cap, and the invention contemplates having such collars on all forms of caps of the invention. The devices including the hair parting and liquid spreading means (except for the cloth, sponge and brush applicators and metal frames for the rollers) are preferably molded of suitable plastic, preferably by injection molding in very smooth dies so as to avoid any protuberances that would catch hair in passing through it and avoid shoulders that would prevent easy run-off of the liquid and thereby avoid unwanted accumulation.

The devices for parting hair and spreading liquid which have been disclosed herein may be used to carry out many hair treating operations. The device of FIGS. 1 and 2, for example, is particularly adapted for spreading hair color altering liquid into roots (new growth) in touch-up operations but it may also be used for distributing liquid into the shaft of a tress of hair. If roots are very short it may be unnecessary to use the spreader because a line of liquid laid down at a part may be sufficient to penetrate the root area, in which case the device of FIG. 60 may be preferred where the discharge orifice 38*vv* is above the point or line of contact of the spreading means 32*vv* with the scalp, as above described. They may also be used for hair painting, high lighting, frosting, tipping and the like.

Although the invention has been described in connection with many specific embodiments thereof, it will be understood that modifications and alterations may be made without departing from the invention as herein described and claimed.

Having thus described the invention what is claimed is:

1. A device for use in selectively altering hair color comprising closure means adapted to be removably secured to a squeeze bottle to close an open end thereof, an elongated slender hair parting means secured at its base to and extending upwardly from said closure means having a frustoconical tip at the upper end with a rounded smooth end adapted to penetrate and part the hair, a liquid passageway through said device having a discharge orifice in the surface of said device adapted to deliver liquid from a squeeze bottle when said device is secured thereto, and liquid spreading means on said device having a transversely extending spreading surface spaced from and at an intermediate position between the base and upper end of said hair parting means for spreading liquid into hair after discharge from said orifice without preventing use of said parting means to part the hair.

2. A device as set forth in claim 1 in which said device is integrally molded.

3. A device as set forth in claim 1 in which said spreading means is a molded plastic roller.

4. A device as set forth in claim 3 in which said roller is mounted in a frame and is movable from said intermediate position to a position beyond the tip of said parting means.

5. A device as set forth in claim 1 in which said spreading means is a molded plastic roller rotatably mounted on said slender elongated parting means adjacent to the base thereof, thereby leaving the outer end exposed to serve as a hair parting means.

6. A device as set forth in claim 1 in which said hair parting means is frusto-conical in shape with the larger end at the base and said spreading means comprises an attachment having a frusto-conical recess to fit over and be readily removably held on said frusto-conical parting means.

7. A device for use in altering hair color selectively comprising a squeeze bottle adapted to hold a liquid capable of altering hair color, an elongated slender hair parting means having a base and a frustoconical tip at the upper end with a rounded smooth end adapted to penetrate and part the hair, means for securing said base to said bottle in liquid tight relation, a liquid passage in said device extending into said parting means adapted to convay liquid from the bottle to a discharge orifice on said device and means secured to said device having a transversely extending spreading surface spaced from and at an intermediate position between the base and upper end of said hair parting means for spreading liquid on the hair upon discharge through said orifice without interfering with the use of said parting means to part the hair.

8. A device as set forth in claim 7 in which said spreading means is an integral transverse enlargement on said hair parting means terminating in a rounded end which is spaced (a) laterally from said parting means and (b) inwardly from the upper end thereof.

9. A device as set forth in claim 7 in which said spreading means is a molded plastic roller having an axle upon which it is rotatable and means for securing said axle to said device.

10. A device as set forth in claim 9 in which said means for securing said axle to said device comprises at least one arm having one end secured to said axle and the other end secured to said device.

11. A device as set forth in claim 10 in which said axle is integral with said arm.

12. A device as set forth in claim 10 in which the other end is secured to the squeeze bottle.

13. A device as set forth in claim 10 in which the means for removably securing said base to said bottle in liquid tight relation comprises a cap removable having a collar and a closure means integral therewith with which said base is integral and the other end of said arm is secured to said cap.

14. A device as set forth in claim 10 in which said means for securing said axle to said device comprises two arms, each secured at one end to said axle adjacent to the respective ends of the roller and at the other end to said device.

15. A device as set forth in claim 13 in which the other end of said arm is secured to said cap by means of a turntable.

16. A device as set forth in claim 13 in which the other end of said arm is slidably mounted in said cap.

17. A device for selectively altering hair color comprising a squeeze bottle having a filling opening; means for closing said opening; a slender, elongated parting tool having a base at one end mounted on said device and a frustoconical tip at the other end, said tip having a smooth rounded upper end which is adapted to penetrate and part the hair, a liquid passageway communicating at one end with said bottle and at the other end with a discharge orifice at the surface of said device, and spreading means on said device spaced laterally from said parting tool and being located an intermediate distance from said bottle between said base and said smooth rounded end.

18. A device as set forth in claim 17 in which said parting tool is mounted directly on said bottle.

19. A device as set forth in claim 17 in which said parting tool is removably secured to said bottle.

20. A device as set forth in claim 17 in which said parting tool is mounted on said means for closing said opening.

21. A device as set forth in claim 18 in which said spreading device is integral with said parting tool and the parting tool is integral with the bottle.

22. A device as set forth in claim 20 in which said means for closing said opening, said parting tool and spreading means are an integral molding.

23. A device for selectively altering hair color comprising means adapted to be removably secured in liquid tight relation to a squeeze bottle comprising a collar and a closure member secured thereto at the upper edge thereof; an elongated, slender hair parting means having a base at one end secured to said closure means and a frustoconical tip at the other end with a rounded smooth end adapted to penetrate and part the hair, and a spreading means secured to said device having a transverse spreading end spaced from said parting means and from said closure member in the direction of but not as far as said rounded smooth end.

24. A device as set forth in claim 23 in which a line tangent to the rounded smooth end of said tip and said spreading end makes an angle with the axis of the parting tool within the range of about 125° to 165°.

25. A device as set forth in claim 23 in which the base of the parting means is secured to the closure means adjacent to the collar.

26. A device as set forth in claim 23 in which the base of the parting means is secured to the closure means away from the collar.

27. A device as set forth in claim 23 in which the axis of the parting means makes an angle within the range of about 135° to 180° to the axis of the collar.

28. A device as set forth in claim 23 in which the hair parting means is frusto-conical and is joined to the spreading means and closure member by connecting means having a smoothly contoured saddle shaped upper surface and a narrowed portion between the spreading end and the closure member.

29. A device as set forth in claim 28 in which said spreading end is rounded.

* * * * *

UNITED STATES PATENT AND TRADEMARK OFFICE

CERTIFICATE OF CORRECTION

PATENT NO. : 4,211,247

DATED : July 8, 1980

INVENTOR(S) : Shila Morganroth

It is certified that error appears in the above–identified patent and that said Letters Patent are hereby corrected as shown below:

Column 2, line 10, delete "scale" and insert --scalp--.
Column 2, line 66, delete "ightening" and insert --lightening--.
Column 3, line 11, delete "i" and insert --in--.
Column 4, line 11, delete "disensing" and insert --dispensing--.
Column 4, line 44, delete "band" and insert --hand--.
Column 5, line 8, delete "11" and insert --1--.
Column 21, line 36, after "axis" insert --is also the axis--.
Column 23, line 31, delete "cap removable" and insert --removable cap--.

Signed and Sealed this

*Thirtieth* Day of *September 1980*

[SEAL]

*Attest:*

SIDNEY A. DIAMOND

*Attesting Officer*

*Commissioner of Patents and Trademark.*